US010590506B2

(12) United States Patent
Yokoi et al.

(10) Patent No.: US 10,590,506 B2
(45) Date of Patent: Mar. 17, 2020

(54) HOT-ROLLED STEEL SHEET FOR TAILORED ROLLED BLANK AND TAILORED ROLLED BLANK

(71) Applicant: NIPPON STEEL & SUMITOMO METAL CORPORATION, Tokyo (JP)

(72) Inventors: Tatsuo Yokoi, Oita (JP); Eisaku Sakurada, Tokai (JP); Natsuko Sugiura, Kimitsu (JP); Kiyoyuki Fukui, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/398,310

(22) Filed: Apr. 30, 2019

(65) Prior Publication Data

US 2019/0256941 A1 Aug. 22, 2019

Related U.S. Application Data

(62) Division of application No. 15/303,807, filed as application No. PCT/JP2015/002212 on Apr. 23, 2015, now Pat. No. 10,329,637.

(30) Foreign Application Priority Data

Apr. 23, 2014 (JP) ..... 2014-088778
Apr. 23, 2014 (JP) ..... 2014-088779

(51) Int. Cl.

| | |
|---|---|
| ***C21D 9/46*** | (2006.01) |
| ***C22C 38/00*** | (2006.01) |
| ***C22C 38/58*** | (2006.01) |
| ***C21D 6/02*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/28*** | (2006.01) |
| ***C22C 38/30*** | (2006.01) |
| ***C23C 2/06*** | (2006.01) |
| ***C23C 2/28*** | (2006.01) |
| *B21D 22/20* | (2006.01) |

(52) U.S. Cl.

CPC ..... *C21D 9/46* (2013.01); *C21D 6/02* (2013.01); *C21D 8/0226* (2013.01); *C21D 8/0236* (2013.01); *C21D 8/0263* (2013.01); *C21D 8/0278* (2013.01); *C22C 38/00* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/28* (2013.01); *C22C 38/30* (2013.01); *C22C 38/58* (2013.01); *C23C 2/06* (2013.01); *C23C 2/285* (2013.01); *B21D 22/20* (2013.01); *C21D 2211/002* (2013.01); *C21D 2211/005* (2013.01)

(58) Field of Classification Search

CPC ..... C21D 9/46; C21D 6/02; C21D 8/0226; C21D 8/0236; C21D 8/0263; C21D 8/0278; C22C 38/001

See application file for complete search history.

(56) References Cited

FOREIGN PATENT DOCUMENTS

| | | |
|---|---|---|
| CA | 2827844 | 10/2012 |
| CA | 2831551 | 10/2012 |
| JP | 07-290182 | 11/1995 |
| JP | 08-174246 | 7/1996 |
| JP | 11-192502 | 7/1999 |
| JP | 2004-317203 | 11/2004 |
| JP | 2006-272440 | 10/2006 |
| WO | 2008/068352 | 6/2008 |

(Continued)

OTHER PUBLICATIONS

G.K. Williamson et al., "X-Ray Line . . . and Wolfram", Acta Metallurgica, vol. 1, Jan. 1953.

(Continued)

*Primary Examiner* — Jessee R Roe
(74) *Attorney, Agent, or Firm* — Clark & Brody

(57) ABSTRACT

A hot-rolled steel sheet for a tailored rolled blank is provided that has high tensile strength and is excellent in cold formability. The hot-rolled steel sheet has: a chemical composition that contains, in mass %, C, Si, Mn, P, S, Al, N and Ti, with the balance being Fe and impurities, and that satisfies Formula (1); and a microstructure containing, in terms of area ratio, 20% or more of bainite, wherein 50% or more in terms of area ratio of the balance is ferrite. In the interior of the hot-rolled steel sheet an average value of pole densities of an orientation group {100}<011> to {223}<110> is 4 or less, and a pole density of a {332}<113> crystal orientation is 4.8 or less. In an outer layer of the hot-rolled steel sheet, a pole density of a {110}<001> crystal orientation is 2.5 or more. Furthermore, among Ti carbonitrides in the hot-rolled steel sheet, the number density of fine Ti carbo-nitrides having a particle diameter of 10 nm or less is $1.0\times10^{17}$ per $cm^3$ or less, and a bake hardening amount is 15 MPa or more, $$[Ti]-48/14\times[N]-48/32\times[S]\geq0 \quad (1).$$

4 Claims, 1 Drawing Sheet

(56) References Cited

FOREIGN PATENT DOCUMENTS

| | | |
|---|---|---|
| WO | 2008/104610 | 9/2008 |
| WO | 2010/137317 | 12/2010 |

OTHER PUBLICATIONS

G.K. Williamson et al., "Dislocation Densities . . . Debye-Scherrer Spectrum", Philos. Mag., 8 (1956), 34.
Tsuchiyama, "Physical Meaning of . . . Heat Treatment Process", Netsushori, 42 (2002), 163, with partial English translation.

HOT-ROLLED STEEL SHEET FOR TAILORED ROLLED BLANK AND TAILORED ROLLED BLANK

This application is a Divisional of U.S. Ser. No. 15/303,807 filed on Oct. 13, 2016, which is a national phase of PCT/JP2015/002212 filed on Apr. 23, 2015.

TECHNICAL FIELD

The present invention relates to a hot-rolled steel sheet for a tailored rolled blank, a tailored rolled blank, and methods for producing these.

BACKGROUND ART

In recent years, the weights of various components that constitute automobiles are being reduced with the objective of improving the fuel consumption of the automobiles. The method of reducing the weight differs depending on the performance requirements for the respective components. For example, for a framework component, wall thinning is carried out by enhancing the strength of a steel sheet. For a panel component, measures such as substitution of a steel sheet with a light metal sheet such as an Al alloy are taken.

However, a light metal sheet such as an Al alloy is expensive in comparison to a steel sheet. Therefore, utilization of light metal sheets is mainly limited to luxury automobiles. The demand for automobiles is shifting from developed countries to emerging countries, and it is expected that from now there will be demands to achieve both weight reductions and price reductions. Accordingly, for every component, irrespective of the region, there is a demand to achieve increased strength using a steel sheet and a weight reduction by wall thinning.

When wall thinning is exhaustively carried out, it is necessary to meticulously set the sheet thickness and material quality of component parts of each region. However, in this case the number of components increases and the production cost rises. From the viewpoint of enhancing the accuracy of the body shape and improving productivity and the like, it is preferable that the number of components is as small as possible.

Application of tailored blanks is proceeding as a method that, as much as possible, can meticulously set the sheet thickness and material quality of each region and also reduce the number of components.

The term "tailored blank" refers to a press starting material in which a plurality of steel sheets are joined together according to the purpose. Utilizing a tailored blank makes it possible to partially alter the characteristics of a single starting material and to also reduce the number of components. A tailored blank is normally produced by welding together a plurality of steel sheets. Examples of the welding method include laser welding, mash seam welding, plasma welding and high-frequency induction welding.

Tailored blanks produced by welding in this manner are called "tailored weld blanks". Technology relating to tailored weld blanks is proposed in, for example, Japanese Patent Application Publication No. 7-290182 (Patent Literature 1) and Japanese Patent Application Publication No. 8-174246 (Patent Literature 2).

According to the technology disclosed in Patent Literatures 1 and 2, steel strips of different thicknesses are butted in the width direction and welded by laser welding or the like. However, in a case where tailored weld blanks are produce by applying these technologies, if there is a weld defect at one part of a weld zone, in some cases cracks arise in the weld zone in a pressing process that is after the welding process. In addition, even when a weld zone does not have a weld defect, a hardness difference arises between a weld zone and a base metal portion, and weld undercut portions arise. In such a case, in a subsequent press-forming process, in some cases the stress concentrates at the weld zone during press working, and cracks arise in a portion of the weld zone.

As described above, when welding together steel sheets of different strengths that have different sheet thicknesses by using a welding process that is currently in practical use such as laser welding, mash seam welding, arc welding or high-frequency welding, it is difficult to make the quality of the weld zone uniform, and a weld defect is liable to occur.

Therefore, tailored rolled blanks have been proposed as another kind of tailored blank that does not utilize welding. A tailored rolled blank is a steel sheet of varying thickness on which partial wall thinning has been carried out by rolling. Technology relating to tailored rolled blanks is disclosed in Japanese Patent Application Publication No. 11-192502 (Patent Literature 3), Japanese Patent Application Publication No. 2006-272440 (Patent Literature 4), International Application Publication. No. WO 2008/068352 (Patent Literature 5) and International Application Publication No. WO 2008/104610 (Patent Literature 6).

According to the technology discussed in Patent Literature 3, a steel strip is rolled with work rolls of a special shape to produce a steel strip in which the sheet thickness varies in the width direction. However, when utilizing this technology, it is necessary to prepare a plurality of single-purpose work rolls that correspond to the shape of the steel strip for a tailored blank.

According to technology discussed in Patent Literature 4, a steel sheet of varying thickness is produced without using work rolls of a special shape. Specifically, at least at one location at an intermediate portion in the longitudinal direction of the sheet thickness, rolling is performed by changing the setting of a rolling reduction position so that the sheet thickness changes in a tapered shape within a predetermined length range, to thereby produce a tailored rolled blank. However, in Patent Literature 4, there is no discussion regarding the chemical composition and microstructure and the like of a steel strip to be used for a tailored rolled blank.

In Patent Literatures 5 and 6, a chemical composition of a steel sheet for a tailored rolled blank and a method for producing a steel sheet for a tailored rolled blank are disclosed. According to the technology disclosed in Patent Literatures 5 and 6, using a steel strip having a specific chemical composition, rolling is performed while controlling a roll gap so that the sheet thickness changes in the rolling direction. After rolling, a heat treatment is performed, and the yield strength of a thick-wall portion of the tailored rolled blank is made equal to or greater than the yield strength of a thin-wall portion.

According to the technology disclosed in International Application Publication No. WO 2010/137317 (Patent Literature 7), a steel sheet having a specific chemical composition is subjected to hot rolling under specific conditions to produce a hot-rolled steel sheet. Cold rolling is executed at a reduction of 0.1 to 5.0% on a hot-rolled steel sheet to produce a cold-rolled steel sheet. A heat treatment is executed under specific conditions on the cold-rolled steel sheet to produce a high-strength steel sheet that is excellent in elongation properties.

CITATION LIST

Patent Literature

Patent Literature 1: Japanese Patent Application Publication No. 7-290182
Patent Literature 2: Japanese Patent Application Publication No. 8-174246
Patent Literature 3: Japanese Patent Application Publication No. 11-192502
Patent Literature 4: Japanese Patent Application Publication No. 2006-272440
Patent Literature 5: International Application Publication No. WO 2008/068352
Patent Literature 6: International Application Publication No. WO 2008/104610
Patent Literature 7: International Application Publication No. WO 2010/137317
Patent Literature 8: Japanese Patent Application Publication No. 2004-317203

Non Patent Literature

Non Patent Literature 1: G. K. Williams and W. H. Hall: Act. Metall., 1 (1953), 22
Non Patent Literature 2: G. K. Williams and R. E. Smallman: Philos. Mag., 8 (1956), 34
Non Patent Literature 3: T. Tsuchiyama: Heat Treatment 42 (2002), 163

However, according to the technology disclosed in Patent Literatures 5 and 6, if the strength of the steel strip is high, the rolling reaction force during cold rolling increases. In such a case, an excessive facility load and an increase in the number of rolling operations and the like are required in order to form a thin-wall portion by rolling. Consequently, the productivity decreases. The sheet thickness accuracy and shape accuracy also decrease. In addition, when the yield strength of a thick-wall portion is equal to or greater than the yield strength of a thin-wall portion, although it is considered preferable in terms of usability after pressing, if a difference between the yield strength of a thick-wall portion and a thin-wall portion is too large, a deformation will concentrate at the thin-wall portion during cold forming (cold pressing or the like) and a rupture is liable to occur. Further, even if cold rolling of around 5% is performed as in the case of the technology described in Patent Literature 7, a sheet thickness difference between a thick-wall portion and a thin-wall portion that is required as a tailored rolled blank cannot be obtained.

SUMMARY OF INVENTION

An objective of the present invention is to provide a hot-rolled steel sheet for a tailored rolled blank that is capable of producing a tailored rolled blank that has a tensile strength of 590 MPa or more and is excellent in cold formability, a tailored rolled blank produced using the hot-rolled steel sheet, and methods for producing these.

A hot-rolled steel sheet for a tailored rolled blank according to the present embodiment has a chemical composition consisting of, in mass %, C: 0.03 to 0.1%, Si: 1.5% or less, Mn: 1.0 to 2.5%, P: 0.1% or less, S: 0.02% or less, Al: 0.01 to 1.2%, N: 0.01% or less, Ti: 0.015 to 0.15%, Nb: 0 to 0.1%, Cu: 0 to 1%, Ni: 0 to 1%, Mo: 0 to 0.2%, V: 0 to 0.2%, Cr: 0 to 1%, W: 0 to 0.5%, Mg: 0 to 0.005%, Ca: 0 to 0.005%, rare earth metal: 0 to 0.1%, B: 0 to 0.005%, and one or more types of element selected from a group consisting of Zr, Sn, Co and Zn in a total amount of 0 to 0.05%, with the balance being Fe and impurities, and satisfying Formula (1), and has a microstructure containing, in terms of area ratio, 20% or more of bainite, with 50% or more in terms of area ratio of the balance being ferrite. At a depth position that is equivalent to one-half of a sheet thickness from a surface of the hot-rolled steel sheet, an average value of pole densities of an orientation group {100}<011> to {223}<110> consisting of crystal orientations {100}<011>, {116}<110>, {114}<110>, {113}<110>, {112}<110>, {335}<110> and {223}<110> is four or less and a pole density of a {332}<113> crystal orientation is 4.8 or less. At a depth position that is equivalent to one-eighth of the sheet thickness from the surface of the hot-rolled steel sheet, a pole density of a {110}<001> crystal orientation is 2.5 or more. In addition, a number density of fine Ti carbo-nitrides having a particle diameter of 10 nm or less in the hot-rolled steel sheet is $1.0\times10^{17}$ per $cm^3$ or less, and a bake hardening amount is 15 MPa or more.

$$[Ti]-48/14\times[N]-48/32\times[S]\geq0 \quad (1)$$

Where, a content (mass %) of a corresponding element is substituted for each symbol of an element in Formula (1).

In a tailored rolled blank according to the present embodiment, a sheet thickness changes in a tapered shape in a rolling direction. The tailored rolled blank includes a thick-wall portion, and a thin-wall portion that is thinner than the thick-wall portion. In the tailored rolled blank, a ratio of an average hardness $H_{t\ max}$ of a thickest wall portion at which the sheet thickness is thickest to an average hardness $H_{t\ min}$ of a thinnest wall portion at which the sheet thickness is thinnest is in a range of more than 1.0 to 1.5. In addition, an average dislocation density of the thinnest wall portion is $1\times10^{14}$ $m^{-2}$ or less, and a number density of fine Ti carbo-nitrides having a particle diameter of 10 nm or less is more than $2\times10^{17}$ per $cm^3$.

A method for producing a hot-rolled steel sheet for a tailored rolled blank according to the present embodiment includes: a step of heating at not less than a temperature $SRT_{min}$ defined by Formula (2) a slab containing, in mass %, C: 0.03 to 0.1%, Si: 1.5% or less, Mn: 1.0 to 2.5%, P: 0.1% or less, S: 0.02% or less, Al: 0.01 to 1.2%, N: 0.01% or less, Ti: 0.015 to 0.15%, Nb: 0 to 0.1%, Cu: 0 to 1%, Ni: 0 to 1%, Mo: 0 to 0.2%, V: 0 to 0.2%, Cr: 0 to 1%, W: 0 to 0.5%, Mg: 0 to 0.005%, Ca: 0 to 0.005%, rare earth metal: 0 to 0.1%, B: 0 to 0.005%, and one or more types of element selected from a group consisting of Zr, Sn, Co and Zn in a total amount of 0 to 0.05%, with the balance being Fe and impurities, and satisfying Formula (1); a step of producing a rough bar by performing rough rolling with an overall reduction of 60 to 90% with respect to the slab that is heated, and during the rough rolling, performing one rolling pass or more at a reduction of 20% or more when a slab temperature is 1050 to 1150° C.; a step of producing a steel sheet by starting finish rolling with respect to the rough bar within 150 seconds after rough rolling ends, and performing finish rolling in which a temperature of the rough bar when starting the finish rolling is in a range of 1000° C. to less than 1080° C., an overall reduction is set in a range of 75 to 95%, a total reduction in a final two passes is set to 30% or more, a finish rolling ending temperature is set in a range from an $Ar_3$ transformation temperature to 1000° C., and a shape ratio SR that is defined by Formula (3) is set to 3.5 or more; a step of starting cooling of the steel sheet within three seconds after finish rolling ends, setting a cooling stopping temperature to 600° C. or less, and setting an average cooling rate until the cooling stopping temperature as 15° C. per second or more to thereby cool the steel sheet, and making a total cumulative diffusion length $L_{total}$, that is defined by Formula (4), in a time period until coiling starts after the temperature of the steel sheet passes an $Ar_3$ transformation temperature 0.15 μm or less; and a step of coiling the steel sheet after cooling at a coiling temperature of 600° C. or less.

$$[Ti]-48/14\times[N]-48/32\times[S]\geq 0\% \quad (1)$$

$$SRT_{min}=10780/\{5.13-\log([Ti]\times[C])\}-273 \quad (2)$$

$$SR=ld/hm \quad (3)$$

$$L_{total}=\Sigma\sqrt{(D(T)\Delta t_L)} \quad (4)$$

Where, a content (mass %) of a corresponding element is substituted for each symbol of an element in Formula (1) and Formula (2). In Formula (3), "ld" represents a length of an arc of contact between a rolling roll that performs a final rolling reduction in the finish rolling and the steel sheet, and is defined by the following formula.

$$ld=\sqrt{(L\times(h_{in}-h_{out})/2)}$$

Where, L (mm) represents a diameter of the rolling roll, $h_{in}$ represents a sheet thickness (mm) of the steel sheet at an entrance side of the rolling roll, and $h_{out}$ represents a sheet thickness (mm) of the steel sheet at an exit side of the rolling roll, and where hm is defined by the following formula.

$$hm=(h_{in}+h_{out})/2$$

In Formula (4), $\Delta t_L$ represents a time period until coiling starts after the temperature of the steel sheet passes the $Ar_3$ transformation temperature, and is a very small time period of 0.2 seconds. D(T) represents a volume diffusion coefficient of Ti at T° C., and is defined by the following formula when a diffusion coefficient of Ti is represented by D0, an activation energy is represented by Q, and a gas constant is represented by R.

$$D(T)=D0\times\mathrm{Exp}\{-Q/R(T+273)\}$$

A method for producing a tailored rolled blank according to the present embodiment uses the aforementioned hot-rolled steel sheet. The present method for producing a tailored rolled blank includes a step of producing a cold-rolled steel sheet by performing cold rolling on the hot-rolled steel sheet while changing a reduction within a range of more than 5% to 50% so that a sheet thickness changes in a tapered shape in a longitudinal direction of the hot-rolled steel sheet, and a step of performing a precipitation hardening heat treatment on the cold-rolled steel sheet. In the precipitation hardening heat treatment, a highest heating temperature $T_{max}$ is 600 to 750° C., a holding time period $t_K$ (sec) at 600° C. or more satisfies Formula (5) with respect to the highest heating temperature $T_{max}$, and a heat treatment index IN defined by Formula (6) is 16500 to 19500.

$$530-0.7\times T_{max}\leq t_K\leq 3600-3.9\times T_{max} \quad (5)$$

$$IN=(T_n+273)(\log(t_n/3600)+20) \quad (6)$$

Where, $t_n$ (sec) in Formula (6) is defined by Formula (7).

$$t_n/3600=10^X+\Delta t_{IN}/3600 \quad (7)$$

Where, $X=((T_{n-1}+273)/(T_n+273))(\log(t_{n-1}/3600)+20)-20$. Further, $t1=\Delta t_{IN}$, and $\Delta t_{IN}$ is one second.

$T_n$(° C.) in Formula (6) is defined by Formula (8).

$$T_n=T_{n-1}+\alpha\Delta t_{IN} \quad (8)$$

Where, α represents a rate of temperature increase or a cooling rate (° C./s) at the temperature $T_{n-1}$.

By using the hot-rolled steel sheet for a tailored rolled blank according to the present embodiment, a tailored rolled blank having high strength and excellent in cold formability can be produced.

DESCRIPTION OF EMBODIMENTS

Figure 1A:
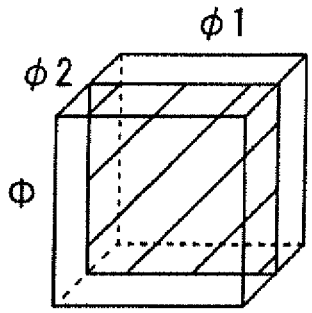
FIG. 1A is a schematic diagram of Euler space that takes angular variables φ1, φ2 and Φ as rectangular coordinates in an ODF (orientation distribution function).

The present inventors studied the relation between cold formability and material quality at a thickest wall portion and a thinnest wall portion with respect to various tailored rolled blanks satisfying the following conditions (a) to (e). As a result, the findings described below were obtained.

(a) performance of heat treatment after cold rolling;

(b) formation of a thick-wall portion and a thin-wall portion by cold rolling in which a reduction is more than 5%;

(c) a space (distance) between a thick-wall portion and a thin-wall portion that is adjacent thereto is several meters or less;

(d) one or a plurality of thick-wall portions and thin-wall portions exist; and (e) a sheet thickness changes in a tapered shape in a rolling direction.

A heat treatment that is performed after cold rolling that is described in the above (a) improves ductility by finely precipitating precipitates in the steel to cause precipitation hardening to act, and also reducing the dislocation density in the steel. This heat treatment is referred to as "precipitation hardening heat treatment".

The present inventors first conducted studies regarding the cold formability of tailored rolled blanks. Specifically, the present inventors prepared tailored blanks in which the sheet thickness varied in the rolling direction (sample 1), and tailored blanks in which the yield strength varied in the rolling direction (sample 2). A spherical stretch forming test and a rectangular cylinder drawing test were performed on each sample.

The test results showed that, in each test using sample 1, the tailored blank ruptured at a thin-wall portion. In addition, the forming height was lower than a steel sheet having an identical sheet thickness as a thin-wall portion of sample 1 and in which the sheet thickness is constant. In each test using sample 2, a portion having low strength ruptured. In addition, the forming height thereof was lower than a steel sheet having an identical yield strength as a high-strength portion of sample 2 and in which the yield strength is uniform.

Based on the above described test results it is considered that when performing a cold forming process on a blank including portions that have different deformation resistances to each other, a deformation concentrates at a portion at which the apparent deformation resistance is low, and the blank is liable to rupture before being adequately formed. Therefore, it is necessary to increase the strength of a thin-wall portion that has a low deformation resistance.

Next, the present inventors performed a more detailed test with respect to a steel sheet of varying thickness in which a ratio ($TH_{min}/TH_{max}$) of a sheet thickness $TH_{min}$ of a thin-wall portion to a sheet thickness $TH_{max}$ of a thick-wall portion was 0.6 or less. As a result, the following findings were obtained. If a ratio ($H_{t\ max}/H_{t\ min}$) of an average hardness $H_{t\ max}$ of a thickest wall portion to an average hardness $H_{t\ min}$ of a thinnest wall portion is in a range of more than 1.0 to 1.5, it is difficult for concentration of deformation to occur at the time of a forming process. Consequently, excellent cold formability is obtained in both the spherical stretch forming test and the rectangular cylinder drawing test. More specifically, if $H_{t\ max}/H_{t\ min}$ is in a range of more than 1.0 to 1.5, the forming height of a steel sheet which has a sheet thickness that is equal to a thinnest wall portion and in which the sheet thickness is uniform, and which also has an average hardness that is equal to the average hardness $H_{t\ min}$ of the thinnest wall portion is kept at about 80%.

In addition, in a case where an average dislocation density of a thinnest wall portion of a tailored rolled blank is more than $1\times10^{14}$ $m^{-2}$, sufficient cold formability cannot be obtained. This is because it is not possible to recover from the strain introduced to a tailored rolled blank by cold rolling by performance of the precipitation hardening heat treatment that is performed thereafter. Accordingly, the average dislocation density at a thinnest wall portion of the tailored rolled blank is set as $1\times10^{14}$ $m^{-2}$ or less.

Furthermore, in the tailored rolled blank, in a case where a number density $n_1$ of fine Ti carbo-nitrides (Ti(C, N)) having a particle diameter of 10 nm or less is $2\times10^{17}$ per $cm^3$ or less, precipitation hardening is insufficient and a target strength is not obtained. Accordingly, the number density $n_1$ of the fine Ti carbo-nitrides is more than $2\times10^{17}$ per $cm^3$.

To obtain a tailored rolled blank that satisfies the above described conditions, the present inventors studied the conditions required for a hot-rolled steel sheet that serves as a starting material for a tailored rolled blank.

Specifically, a slab having a chemical composition consisting of 0.06% of C, 0.15% of Si, 1.9% of Mn, 0.01% of P, 0.002% of S, 0.035% of Al, 0.09% of Ti, 0.035% of Nb and 0.004% of N was prepared. Using the slab, a plurality of hot-rolled steel sheets for a tailored rolled blank in which the microstructure, number density of Ti carbo-nitrides, aggregate structure and sheet thickness were different were produced using various production conditions. Thereafter, using the hot-rolled steel sheets that were produced, based on the assumption of use for tailored rolled blanks, cold rolling was performed and cold-rolled steel sheets were produced. The reduction in the cold rolling was in a range of more than 5 to 50%. Precipitation hardening heat treatment was performed under various production conditions on the cold-rolled steel sheets that were produced, to thereby produce tailored rolled blanks. Samples were extracted from the above described hot-rolled steel sheets, cold-rolled steel sheets, and tailored rolled blanks, and the microstructure, precipitate state, and aggregate structure were examined. The findings described hereunder were obtained as a result.

[Regarding Microstructure of Hot-Rolled Steel Sheet]

With regard to the microstructure of the hot-rolled steel sheet for a tailored rolled blank, in a case where the area ratio of bainite is less than 20%, the balance is mainly ferrite. However, when a hot-rolled steel sheet having such a microstructure is produced by a normal method for producing a hot-rolled steel sheet, transformation to ferrite from austenite progresses during cooling after finish rolling. In this case, using a difference in the solubility of Ti, C and N between austenite and ferrite as a driving force, Ti carbo-nitrides precipitate, ferrite undergoes precipitation hardening, and the strength of the hot-rolled steel sheet becomes too high. If the strength of the hot-rolled steel sheet is too high, the rolling reaction force increases in cold rolling. Consequently, the dimensional accuracy (sheet thickness accuracy and sheet width accuracy) of the tailored rolled blank is reduced, and cold formability decreases. On the other hand, if a case is supposed in which precipitation hardening of Ti carbo-nitride is in an over-aging state and the strength of the hot-rolled steel sheet is low, Ti carbo-nitrides will not be subjected to precipitation hardening by a precipitation hardening heat treatment that is a subsequent process. If the microstructure of a hot-rolled steel sheet contains 20% or more of bainite, an excessive increase in the strength of the hot-rolled steel sheet can be suppressed, and the cold formability of the hot-rolled steel sheet is enhanced.

[Regarding Precipitate (Ti Carbo-Nitride) in Hot-Rolled Steel Sheet]

Further, a smaller amount of Ti carbo-nitrides in a hot-rolled steel sheet is preferable. If a large amount of Ti carbo-nitrides precipitate in the hot-rolled steel sheet, as described above, the strength of the hot-rolled steel sheet will become too high due to precipitation hardening. In such a case, the cold formability will decrease. When the amount of Ti carbo-nitrides in a hot-rolled steel sheet is small, Ti, C and N are in a solid-solution state, or the Ti carbo-nitrides are in a cluster shape. In this case, precipitation hardening does not occur in the hot-rolled steel sheet, and breaking elongation increases. As a result, the rolling reaction force decreases during cold rolling, and cold formability is enhanced. Specifically, excellent cold formability is obtained when a number density of fine Ti carbo-nitrides having a particle diameter of 10 nm or less is $1.0\times10^{17}$ per $cm^3$ or less, and a bake hardening amount (hereunder, referred to as "BH amount") is 15 MPa or more.

The term "cluster-shaped Ti carbo-nitrides" refers to Ti carbo-nitrides of an indefinite shape in which the crystalline structure is not an NaCl structure and the shape is not a sheet shape. Cluster-shaped Ti carbo-nitrides are an aggregate in which, in terms of the number of atoms, the number of Ti atoms is 100 to 200. Cluster-shaped Ti carbo-nitrides are difficult to observe with a transmission electron microscope because a clear NaCl structure is not formed, and the Ti carbo-nitrides can be defined as a cluster if an aggregate of Ti of the above described number of atoms and C, N is recognized using 3D-AP. Thin-film test samples for a transmission electron microscope and test samples for 3D-AP are extracted from the same sample, and a plurality of samples of each are observed with a magnification of ×5 or more. At such time, if clear precipitate is not recognized with the transmission electron microscope in a majority of the samples observed with a magnification of ×5, and the number of Ti atoms is 100 to 200 and the Ti atoms and C atoms are observed at the same coordinates using 3D-AP, it can be determined that the Ti carbo-nitrides are cluster-shaped Ti carbo-nitrides.

[Regarding Aggregate Structure of Hot-Rolled Steel Sheet]

Cold formability can be enhanced by satisfying the following points with respect to an aggregate structure in a hot-rolled steel sheet.

In a range of depths from five-eighths to three-eighths of the sheet thickness from the surface of a hot-rolled steel sheet (hereunder, this range is referred to as "interior"), an average value of pole densities D1 of an orientation group {100}<011> to {223}<110> consisting of respective crystal orientations {100}<011>, {116}<110>, {114}<110>, {113}<110>, {112}<110>, {335}<110> and {223}<110> is made four or less and a pole density D2 of a {332}<113> crystal orientation is made 4.8 or less.

In short, in the interior of the hot-rolled steel sheet, the crystal orientation is made as random as possible. In a case where the average value of pole densities D1 of the orientation group {100}<011> to {223}<110> is four or less and the pole density D2 of the {332}<113> crystal orientation is 4.8 or less, the in-plane anisotropy of the tensile strength and breaking elongation decreases. Specifically, a value of |Δr| that is an index of the in-plane anisotropy of the tensile strength and breaking elongation is 0.6 or less. Specifically, in a case where an average of the tensile strength in the rolling direction, the sheet-width direction, and a direction that is inclined by 45° relative to the rolling direction is 720 MPa, the standard deviation for the three directions is 12 MPa or less. Further, in a case where the average of the breaking elongation in the three directions is 17%, the standard deviation for the three directions is 0.8% or less. Because the in-plane anisotropy decreases, the sheet thickness accuracy and sheet width accuracy increase and cold formability is enhanced.

On the other hand, in an outer layer in a range from the surface of the hot-rolled steel sheet to a depth equivalent to three-eighths of the sheet thickness, a pole density D3 of a {110}<001> crystal orientation is set to 2.5 or more.

In short, while the crystal orientation in the interior is made as random as possible, on the outer layer, a proportion occupied by a {110}<001> crystal orientation that is a specific crystal orientation is increased as much as possible. In the chemical composition of the present embodiment, grains of the {110}<001> crystal orientation are not susceptible to work hardening. When producing a tailored rolled blank, the reduction is partially changed during cold rolling to produce a thick-wall portion and a thin-wall portion in the steel sheet. Accordingly, the reduction during the cold rolling differs between a thick-wall portion and a thin-wall portion. If the reductions are different, the amount of strain that is introduced will also be different. Therefore, a difference in work hardening arises between a thick-wall portion and a thin-wall portion, and thus a difference arises in the hardness. A difference in the hardness is liable to arise, in particular, between outer layer portions of a thick-wall portion and a thin-wall portion.

As described above, the grains of the {110}<001> crystal orientation are not susceptible to work hardening. Further, as described later, in the present embodiment the cold-rolling rate is in a range from more than 5% to 50%. In this case, even after cold rolling, the {110}<001> crystal orientation remains in the outer layer. Consequently, if the pole density D3 of the {110}<001> crystal orientation is 2.5 or more, a hardness difference between a thick-wall portion and a thin-wall portion of the tailored rolled blank can be reduced, and variations in the hardness can be suppressed. As a result, the sheet thickness accuracy and sheet width accuracy are increased, and the cold formability is improved.

If a tailored rolled blank is produced by subjecting the aforementioned hot-rolled steel sheet to cold rolling in which the reduction is in a range of more than 5% to 50%, and performing precipitation hardening heat treatment under conditions that are described later, the aforementioned hardness ratio HR ($=H_{t\ max}/H_{t\ min}$=more than 1.0 to 1.5) is obtained in the tailored rolled blank that is produced. In addition, the average dislocation density of a thinnest wall portion is $1\times10^{14}$ $m^{-2}$ or less and a number density $n_1$ of Ti carbo-nitrides for which a circle-equivalent diameter is 0.5 to 10 nm is more than $2\times10^{17}$ per $cm^3$.

A hot-rolled steel sheet of the present embodiment that was completed based on the above described findings is a hot-rolled steel sheet that is used for a tailored rolled blank. The hot-rolled steel sheet has a chemical composition consisting of, in mass %, C: 0.03 to 0.1%, Si: 1.5% or less, Mn: 1.0 to 2.5%, P: 0.1% or less, S: 0.02% or less, Al: 0.01 to 1.2%, N: 0.01% or less, Ti: 0.015 to 0.15%, Nb: 0 to 0.1%, Cu: 0 to 1%, Ni: 0 to 1%, Mo: 0 to 0.2%, V: 0 to 0.2%, Cr: 0 to 1%, W: 0 to 0.5%, Mg: 0 to 0.005%, Ca: 0 to 0.005%, rare earth metal: 0 to 0.1%, B: 0 to 0.005%, and one or more types of element selected from a group consisting of Zr, Sn, Co and Zn in a total amount of 0 to 0.05%, with the balance being Fe and impurities, and satisfying Formula (1), and has a microstructure containing, in terms of area ratio, 20% or more of bainite, with 50% or more in terms of area ratio of the balance being ferrite. At a depth position that is equivalent to one-half of a sheet thickness from a surface of the hot-rolled steel sheet, an average value of pole densities of an orientation group {100}<011> to {223}<110> consisting of crystal orientations {100}<011>, {116}<110>, {114}<110>, {113}<110>, {112}<110>, {335}<110> and {223}<110> is four or less and a pole density of a {332}<113> crystal orientation is 4.8 or less. At a depth position that is equivalent to one-eighth of the sheet thickness from the surface of the hot-rolled steel sheet, a pole density of a {110}<001> crystal orientation is 2.5 or more. In addition, a number density of fine Ti carbo-nitrides having a particle diameter of 10 run or less among Ti carbo-nitrides in the hot-rolled steel sheet is $1.0\times10^{17}$ per $cm^3$ or less, and a bake hardening amount is 15 MPa or more.

$$[Ti]-48/14\times[N]-48/32\times[S]\geq0 \quad (1)$$

Where, a content (mass %) of a corresponding element is substituted for each symbol of an element in Formula (1).

The above described chemical composition of the hot-rolled steel sheet may contain one or more types of element selected from a group consisting of Nb: 0.005 to 0.1%, Cu: 0.005 to 1%, Ni: 0.005 to 1%, Mo: 0.005 to 0.2%, V: 0.005 to 0.2%, Cr: 0.005 to 1% and W: 0.01 to 0.5%. The above described chemical composition may also contain one or more types of element selected from a group consisting of Mg: 0.0005 to 0.005%, Ca: 0.0005 to 0.005%, and rare earth metal: 0.0005 to 0.1%. The above described chemical composition may also contain B: 0.0002 to 0.005%. The chemical composition may contain one or more types of element selected from the group consisting of Zr, Sn, Co and Zn in a total amount of 0.005 to 0.05%.

In a tailored rolled blank according to the present embodiment, a sheet thickness changes in a tapered shape in a rolling direction. The present tailored rolled blank includes a thick-wall portion, and a thin-wall portion that is thinner than the thick-wall portion. In the tailored rolled blank, a ratio of an average hardness $H_{t\ max}$ of a thickest wall portion at which the sheet thickness is thickest to an average hardness $H_{t\ min}$ of a thinnest wall portion at which the sheet thickness is thinnest is in a range of more than 1.0 to 1.5. An average dislocation density of the thinnest wall portion is $1\times10^{14}$ $m^{-2}$ or less. A number density of fine Ti carbo-nitrides having a particle diameter of 10 nm or less is more than $2\times10^{17}$ per $cm^3$.

Preferably, the aforementioned tailored rolled blank is produced using the aforementioned hot-rolled steel sheet. The aforementioned tailored rolled blank may include a galvanized layer on the surface thereof.

A method for producing a hot-rolled steel sheet for a tailored rolled blank according to the present embodiment includes: a step of heating a slab having the above described chemical composition and satisfying Formula (1), at not less than a temperature $SRT_{min}$ defined by Formula (2); a step of producing a rough bar by performing rough rolling with an overall reduction of 60 to 90% with respect to the slab that is heated, and during the rough rolling, performing one rolling pass or more at a reduction of 20% or more when the slab temperature is 1050 to 1150° C.; a step of producing a steel sheet by starting finish rolling with respect to the rough bar within 150 seconds after rough rolling ends, and performing finish rolling in which a temperature of the rough bar when starting the finish rolling is in a range of 1000° C. to less than 1080° C., an overall reduction is set in a range of 75 to 95%, a total reduction in a final two passes is set to 30% or more, a finish rolling ending temperature is set in a range from an $Ar_3$ transformation temperature to 1000° C., and a shape ratio SR that is defined by Formula (3) is set to 3.5 or more; a step of starting cooling of the steel sheet within three seconds after finish rolling ends, setting a cooling stopping temperature to 600° C. or less, and setting an average cooling rate until the cooling stopping temperature as 15° C. per second or more to thereby cool the steel sheet, and making a total cumulative diffusion length $L_{total}$, that is defined by Formula (4), in a time period until coiling starts after the temperature of the steel sheet passes an $Ar_3$ transformation temperature 0.15 μm or less; and a step of coiling the steel sheet after cooling at a coiling temperature of 600° C. or less.

$$[Ti]-48/14\times[N]-48/32\times[S]\geq 0\% \quad (1)$$

$$SRT_{min}=10780/\{5.13-\log([Ti]\times[C])\}-273 \quad (2)$$

$$SR=ld/hm \quad (3)$$

$$L_{total}=\Sigma\sqrt{(D(T)\Delta t_L)} \quad (4)$$

Where, a content (mass %) of a corresponding element is substituted for each symbol of an element in Formula (1) and Formula (2). In Formula (3), "ld" represents a length of an arc of contact between a rolling roll that performs a final rolling reduction in the finish rolling and the steel sheet, and is defined by the following formula.

$$ld=\sqrt{(L\times(h_{in}-h_{out})/2)}$$

Where, L (mm) represents a diameter of the rolling roll, $h_{in}$ represents a sheet thickness (mm) of the steel sheet at an entrance side of the rolling roll, and $h_{out}$ represents a sheet thickness (mm) of the steel sheet at an exit side of the rolling roll, and where bin is defined by the following formula.

$$hm=(h_{in}+h_{out})/2$$

In Formula (4), $\Delta t_L$ represents a time period until coiling starts after the temperature of the steel sheet passes the $Ar_3$ transformation temperature, and is a very small time period of 0.2 seconds. D(T) represents a volume diffusion coefficient of Ti at T° C., and is defined by the following formula when a diffusion coefficient of Ti is represented by D0, an activation energy is represented by Q, and a gas constant is represented by R.

$$D(T)=D0\times\mathrm{Exp}\{-Q/R(T+273)\}$$

The method for producing a tailored rolled blank according to the present embodiment uses the aforementioned hot-rolled steel sheet. The present method for producing a tailored rolled blank includes: a step of producing a cold-rolled steel sheet by performing cold rolling on the hot-rolled steel sheet while changing a reduction within a range of more than 5% to 50% so that a sheet thickness changes in a tapered shape in a longitudinal direction of the hot-rolled steel sheet; and a step of performing a precipitation hardening heat treatment on the cold-rolled steel sheet. In the precipitation hardening heat treatment, a highest heating temperature $T_{max}$ is 600 to 750° C., a holding time period $t_K$ (sec) at 600° C. or more satisfies Formula (5) with respect to the highest heating temperature $T_{max}$, and a heat treatment index IN defined by Formula (6) is 16500 to 19500.

$$530-0.7\times T_{max}\leq t_K\leq 3600-3.9\times T_{max} \quad (5)$$

$$IN=(T_n+273)(\log(t_n/3600)+20) \quad (6)$$

Where, $t_n$ (sec) in Formula (6) is defined by Formula (7).

$$t_n/3600=10^X+\Delta t_{IN}/3600 \quad (7)$$

Where, $X=((T_{n-1}+273)/(T_n+273))(\log(t_{n-1}/3600)+20)-20$. Further, $t1=\Delta t_{IN}$, and $\Delta t_{IN}$ is one second.

$T_n$(° C.) in Formula (6) is defined by Formula (8).

$$T_n=T_{n-1}+\alpha\Delta t_{IN} \quad (8)$$

Where, α represents the rate of temperature increase or a cooling rate (° C./s) at the temperature $T_{n-1}$.

The above described method for producing a tailored rolled blank may further include a step of performing a galvanizing treatment before the step of heating the slab, before the step of cooling the steel sheet after finish rolling, before the step of coiling the steel sheet that is cooled, or after the step of performing a precipitation hardening heat treatment. The present method for producing a tailored rolled blank may further include a step of performing an alloying treatment at 450 to 600° C. after performing the galvanizing treatment.

By using the hot-rolled steel sheet of the present embodiment, a tailored rolled blank having a tensile strength of 590 MPa or more and having excellent cold formability can be obtained. The tailored rolled blank can be used for uses such as framework components of automobiles as well as inner sheet members, structural members and underbody members with respect to which a high level of performance is demanded with regard to collision absorption energy, rigidity, fatigue strength and the like.

Hereunder, the hot-rolled steel sheet for a tailored rolled blank, and a tailored rolled blank that is produced using the hot-rolled steel sheet are described in detail.

[Hot-Rolled Steel Sheet for Tailored Rolled Blank]

[Chemical Composition]

The chemical composition of the hot-rolled steel sheet for a tailored rolled blank of the present embodiment contains the following elements. Hereunder, the symbol "%" with respect to the content of each element denotes mass percent.

C: 0.03 to 0.1%

Carbon (C) increases the strength of steel by structural strengthening. In addition, when producing a tailored rolled blank using the present hot-rolled steel sheet, C bonds with Ti to form Ti carbo-nitrides, and increases the strength of a tailored rolled blank by precipitation hardening. If the C content is too low, the above effects are not obtained, and the tensile strength of the tailored rolled blank will be less than 590 MPa. On the other hand, if the C content is too high, the strength becomes too high and elongation of the hot-rolled steel sheet decreases. Accordingly, the C content is in a range of 0.03 to 0.1%. A preferable lower limit of the C content is 0.06%. A preferable upper limit of the C content is 0.09%.

Si: 1.5% or Less

Silicon (Si) is unavoidably contained. Si dissolves in steel to increase the strength of the steel. Si also improves the balance between tensile strength and elongation. However, if the Si content is too high, tiger-striped scale is formed and the surface properties of the hot-rolled steel sheet deteriorate. In this case, the productivity of a pickling treatment that is performed with the objective of removing scale decreases. If the surface properties of the hot-rolled steel sheet deteriorate, the chemical treatability will also decrease, and hence corrosion resistance after coating of the tailored rolled blank will decrease. Accordingly, the Si content is 1.5% or less (not including 0%). A preferable lower limit of the Si content is 0.02%. In this case, as well as the above described effects, the occurrence of scale defects as typified by fish-scale defects and spindle-shaped scale can also be suppressed. A preferable upper limit of the Si content is 0.07%. In this case, the occurrence of tiger-striped scale can be further suppressed.

Mn: 1.0 to 2.5%

Manganese (Mn) contributes to solid-solution strengthening of steel and also increases the hardenability of the steel. If the Mn content is too low, the strength of the steel will be too low, and the tensile strength will be less than 590 MPa. On the other hand, if the Mn content is too high, segregation is liable to occur and the workability and press formability will decrease. Accordingly, the Mn content is from 1.0 to 2.5%. An appropriate range of the Mn content depends on the tensile strength. A preferable Mn content in a tailored rolled blank having a tensile strength of 590 to 700 MPa is 1.0 to 1.8%. A preferable Mn content in a tailored rolled blank having a tensile strength of 700 to 900 MPa is 1.6 to 2.2%. A preferable Mn content in a tailored rolled blank having a tensile strength of 900 MPa or more is 2.0 to 2.5%

Mn also suppresses the occurrence of hot cracking caused by S. In a ease where the content of an element other than Mn for suppressing the occurrence of hot cracking caused by S is insufficient, a ratio of the Mn content ([Mn]) with respect to the S content ([S]) ([Mn]/[S]) is preferably 20 or more.

P: 0.1% or Less

Phosphorus (P) is unavoidably contained. P contributes to solid-solution strengthening of steel. However, if the P content is too high, the workability and weldability of the steel sheet decreases. Accordingly, the P content is 0.1% or less (not including 0%). A preferable lower limit of the P content is 0.005%. A preferable upper limit of the P content is 0.02%.

S: 0.02% or Less

Sulfur (S) is an impurity that is unavoidably contained. S generates inclusions such as MnS and reduces the stretch-flange formability of steel, and also causes cracking during hot rolling. Accordingly, the S content is 0.02% or less (not including 0%). A preferable upper limit of the S content is 0.005%. In this case, the weldability and production stability during casting and during hot rolling increases. Preferably, the S content is as low as possible. However, when production costs are taken into consideration, a lower limit of the S content is, for example, 0.0001%.

Al: 0.01 to 1.2%

Aluminum (Al) deoxidizes steel and reduces dissolved oxygen in molten steel. Therefore, Al can suppress the formation of alloy oxides that are formed by Ti, Nb, Mo and V bonding with dissolved oxygen. If the Al content is too low, this effect is not obtained. On the other hand, if the Al content is too high, a tundish nozzle is liable to clog at the time of casting. Furthermore, if the Al content is too high the chemical treatability and zinc plating properties will decrease. Moreover, if the Al content is too high, a large amount of non-metallic inclusions such as alumina are generated, and the local ductility of the steel decreases. Therefore, the Al content is in a range from 0.01 to 1.2%. A preferable lower limit of the Al content is 0.02%. In a case of further enhancing the chemical treatment and zinc plating properties, a preferable upper limit of the Al content is 0.6%. In a case of further suppressing generation of non-metallic inclusions such as alumina, a preferable upper limit of the Al content is 0.3%.

N: 0.01% or Less

Nitrogen (N) is an impurity that is unavoidably contained. N bonds with Ti, Nb and the like to form nitrides. In this case, if nitrides are formed, it is difficult for Ti and Nb to exhibit the actions that are described later. In addition, these nitrides precipitate at high temperature and tend to coarsen readily, and are liable to act as a starting point of burring cracking. Therefore, the N content is 0.01% or less (not including 0%).

Note that, when using the tailored rolled blank of the present embodiment for a member in which aging deterioration becomes a problem, a preferable upper limit of the N content is 0.006%. Further, when using the tailored rolled blank of the present embodiment with respect to a member based on the premise that the member will be subjected to working after being left to stand at room temperature for two weeks or more after production, a preferable upper limit of the N content is 0.005%. In a case where the tailored rolled blank will be left to stand under a high-temperature environment in summer or will be exported using a marine vessel or the like to a region located across the equator, the preferable upper limit of the N content is less than 0.004%.

Ti: 0.015 to 0.15%

Among various kinds of precipitation hardening elements, titanium (Ti) is the element with the highest precipitation hardening capacity. This is because Ti is the element in which a difference between the solubility in a $\gamma$-phase (austenite) and an $\alpha$-phase (ferrite) is largest. In the present embodiment, precipitation of Ti carbo-nitrides (Ti(C, N)) in the hot-rolled steel sheet is suppressed to the utmost, and Ti is caused to be present in a dissolved state or in a cluster state. Cold rolling is performed on the hot-rolled steel sheet to produce an intermediate product in the shape of a tailored rolled blank. At such time, a large amount of dislocations are introduced into the intermediate product. The intermediate product is subjected to precipitation hardening heat treatment to produce a tailored rolled blank. At such time, Ti carbo-nitrides finely precipitate on the dislocations, and the tailored rolled blank undergoes precipitation hardening. In this way, the strength and elongation of the tailored rolled blank improves.

When the Ti content is too low, the number density of Ti carbo-nitrides in the tailored rolled blank is less than $10^{10}$ per $mm^3$, and the tensile strength of the tailored rolled blank after precipitation hardening heat treatment is less than 590 MPa. In contrast, if the Ti content is too high, the above described effect saturates, and furthermore, a tundish nozzle is liable to clog up. Further, if the Ti content is too high, the austenite recrystallization speed is slow during hot rolling and an aggregate structure of the hot-rolled steel sheet is liable to develop. In this case, in-plane anisotropy increases in the tailored rolled blank after the precipitation hardening heat treatment. In this case, because the cold formability of the hot-rolled steel sheet decreases, the sheet thickness accuracy and sheet width accuracy of the tailored rolled blank becomes lower. Accordingly, the Ti content is from 0.015 to 0.15%. A preferable upper limit of the Ti content is 0.12%.

[Regarding Formula (1)]

The above described chemical composition also satisfies Formula (1).

$$[Ti]-48/14\times[N]-48/32\times[S]\geq 0 \quad (1)$$

Where, a content (mass %) of the corresponding element is substituted for the respective symbols of elements in Formula (1).

As described above, Ti finely precipitates as Ti carbo-nitrides (Ti(C, N)) when subjected to a precipitation hardening heat treatment, and thus the tailored rolled blank undergoes precipitation hardening and the tensile strength thereof is 590 MPa or more. However, Ti has a high affinity with N and S. Therefore, if the Ti content is too low relative to the N content and S content, TiN and TiS are formed without forming Ti carbo-nitrides. Since TiN and TiS are coarse, TiN and TiS do not contribute to improving the strength of the steel. Therefore, Ti must be contained in an amount such that Ti sufficiently precipitates as Ti carbo-nitrides.

F1 is defined as equal to [Ti]−48/14×[N]−48/32×[S]. If F1 is less than 0, the Ti content is too low relative to the N content and S content in the hot-rolled steel sheet. In this case, even if a precipitation hardening heat treatment that is described later is performed on the hot-rolled steel sheet, it will be difficult for Ti carbo-nitrides to be formed. On the other hand, if F1 is 0 or more, a sufficient amount of Ti for precipitating as carbo-nitrides is contained. In this case, the strength of the tailored rolled blank can be raised to 590 MPa or more.

The balance of the chemical composition of the hot-rolled steel sheet of the present embodiment is Fe and impurities. Here, the term "impurities" refers to components that are contained in a raw material of ore, scrap or the like or that are mixed in due to some other cause when industrially producing the hot-rolled steel sheet.

The hot-rolled steel sheet according to the present embodiment may further contain one or more types of element selected from the group consisting of Nb, Cu, Ni, Mo, V, Cr and W as a substitute for a part of Fe. Each of these elements is an optional element. Each of these elements increases the strength of the steel.

Nb: 0 to 0.1%

Niobium (Nb) is an optional element, and need not be contained. In a case where Nb is contained, the Nb increases the strength of the steel by precipitation hardening, similarly to Ti. If even a small amount of Nb is contained, the above described effect is obtained. However, if the Nb content is too high, the precipitation hardening saturates and the elongation and workability decreases. Therefore, the Nb content is from 0 to 0.1%. A preferable lower limit of the Nb content for further effectively obtaining the above described effect is 0.005%, and more preferably is 0.02%. A preferable upper limit of the Nb content is 0.05%.

Cu: 0 to 1%

Copper (Cu) is an optional element, and need not be contained. In a case where Cu is contained, the Cu precipitates independently, and increases the strength of the steel. If even a small amount of Cu is contained, the above described effect is obtained. However, if the Cu content is too high, the steel becomes brittle during hot rolling. Therefore, the Cu content is from 0 to 1%. A preferable lower limit of the Cu content for further effectively obtaining the above described effect is 0.005%.

Ni: 0 to 1%

Nickel (Ni) is an optional element, and need not be contained. In a case where Ni is contained, similarly to Mn, the Ni increases the hardenability of the steel and raises the strength of the steel and also raises the toughness of the steel. In a case where Cu is contained, the Ni also suppresses hot brittleness of the steel. If even a small amount of Ni is contained, the above described effect is obtained. However, if the Ni content is too high, the production costs rise. Therefore, the Ni content is from 0 to 1%. A preferable lower limit of the Ni content for further effectively obtaining the above described effect is 0.005%.

Mo: 0 to 0.2%

V: 0 to 0.2%

Molybdenum (Mo) and vanadium (V) are each optional elements, and need not be contained. In a case where Mo and V are contained, similarly to Ti and Nb, the Mo and V cause the steel to undergo precipitation hardening. If even a small amount of Mo and V is contained, the above described effect is obtained. However, if the Mo and V content is too high, elongation of the steel decreases. Therefore, the Mo content is from 0 to 0.2%, and the V content is from 0 to 0.2%. For further effectively obtaining the above described effect, a preferable lower limit of the Mo content is 0.005% and a preferable lower limit of the V content is 0.005%.

Cr: 0 to 1%

Chromium (Cr) is an optional element, and need not be contained. In a case where Cr is contained, similarly to Mn, the Cr increases the hardenability and raises the strength of the steel and also raises the toughness of the steel. If even a small amount of Cr is contained, the above described effect is obtained. However, if the Cr content is too high, Cr-based alloy carbides that are typified by $Cr_{23}C_6$ precipitate. If Cr-based alloy carbides precipitate at the grain boundary, the press formability decreases. Therefore, the Cr content is from 0 to 1%. A preferable lower limit of the Cr content for further effectively obtaining the above described effect is 0.005%.

W: 0 to 0.5%

Tungsten (W) is an optional element, and need not be contained. In a case where W is contained, the W increases the strength of the steel by precipitation hardening or solid-solution strengthening. If even a small amount of W is contained, the above described effect is obtained. However, if the W content is too high, the above described effect saturates and the production costs rise. Therefore, the W content is from 0 to 0.5%. A preferable lower limit of the W content for further effectively obtaining the above described effect is 0.01%.

The hot-rolled steel sheet according to the present embodiment may further contain one or more types of element selected from the group consisting of Mg, Ca and rare earth metals (REM) as a substitute for a part of Fe. Each of these elements increases the workability of the steel.

Mg: 0 to 0.005%

Ca: 0 to 0.005%

Rare Earth Metal: 0 to 0.1%

Magnesium (Mg), calcium (Ca) and rare earth metals (REM) are each optional elements, and need not be contained. If contained, each of these elements controls the form of non-metallic inclusions. Non-metallic inclusions are the starting points of fractures, and reduce the workability of steel. Therefore, if the form of non-metallic inclusions is controlled, the workability of the steel increases. If even a small amount of these elements is contained, the above described effect is obtained. However, if the content of these elements is too high, the above described effect saturates and the production costs rise. Therefore, the Mg content is from 0 to 0.005%, the Ca content is from 0 to 0.005%, and the REM content is from 0 to 0.1%. For further effectively obtaining the above described effect, a preferable lower limit of the Mg content, a preferable lower limit of the Ca content and a preferable lower limit of the REM content are each 0.0005%.

In the present description, the term "REM" is a generic term for a total of 17 elements of Sc, Y and lanthanoids, and the term "REM content" refers to the total content of the aforementioned elements. In many cases REM elements are added as a misch metal, and are contained in complex form with an element such as La or Ce. Metals such as La and Ce may also be added as an REM.

The hot-rolled steel sheet of the present embodiment may further contain B as a substitute for a part of Fe.

B: 0 to 0.005%

Boron (B) is an optional element, and need not be contained. If contained, B enhances the hardenability of the steel and increases a structural fraction of a low-temperature transformation generating phase that is a hard phase. If even a small amount of B is contained, the above described effect is effectively obtained. However, if the B content is too high, the above described effect saturates and the production costs further rise. Therefore, the B content is from 0 to 0.005%. A preferable lower limit of the B content for further effectively obtaining the above described effect is 0.0002%. In a cooling step after continuous casting, a preferable upper limit of the B content for suppressing the occurrence of slab cracking is 0.0015%.

The hot-rolled steel sheet of the present embodiment may further contain one or more types of element selected from the group consisting of Zr, Sn, Co and Zn as a substitute for a part of Fe.

One or more types of element selected from the group consisting of Zr, Sn, Co and Zn: 0 to 0.05% in total Zirconium (Zr), tin (Sn), cobalt (Co) and zinc (Zn) are each optional elements and need not be contained. If contained, these elements increase the strength of the steel by solid-solution strengthening or precipitation strengthening. These elements also control the form of sulfides and oxides to increase the toughness of the steel. If even a small amount of these elements is contained, the above described effects are obtained. On the other hand, if the total content of these elements is too high, the ductility of the steel decreases. Therefore, the total content of one or more types of element selected from the group consisting of Zr, Sn, Co and Zn is 0 to 0.05%. A preferable lower limit of the total content of these elements is 0.005%. In a case where Sn is contained, if the Sn content is too high, flaws are liable to arise in the steel during hot rolling. Therefore, a preferable upper limit of the Sn content is 0.03%.

[Microstructure]

The microstructure of the hot-rolled steel sheet of the present embodiment contains, in terms of the area ratio, 20% or more of bainite, and the balance is mainly ferrite. Here, the term "the balance is mainly ferrite" means that half (50%) or more of the balance in terms of the area ratio is ferrite. In addition to ferrite, the balance may contain martensite, retained austenite, pearlite and the like. Preferably, the area ratio of martensite in the microstructure is 5% or less, the area ratio of retained austenite is 2% or less, and the area ratio of pearlite is 2% or less. In this case, the local ductility increases and the stretch-flange formability is enhanced.

If the area ratio of bainite in the microstructure is less than 20%, the area ratio of ferrite that is increased in strength by precipitation strengthening is too high, and hence the cold formability of the steel decreases. Specifically, in a case where a tailored rolled blank is produced using a hot-rolled steel sheet in which the bainite area ratio is less than 20%, the strength of the steel sheet excessively increases during cold rolling, and the rolling reaction force rises. In such a case, the dimensional accuracy (sheet thickness accuracy and sheet width accuracy) of the tailored rolled blank decreases and the cold formability also decreases.

Furthermore, if the bainite area ratio is less than 20%, in some cases an over-aging state arises in the hot-rolled steel sheet. In such a case, the strength of the hot-rolled steel sheet decreases. Therefore, the cold formability is maintained. However, an improvement in the strength of the steel sheet by precipitation hardening during a heat treatment after cold rolling is not obtained. Therefore, in the microstructure of the hot-rolled steel sheet, the bainite area ratio is 20% or more, and the balance is mainly ferrite.

In the present embodiment, to dissolve or cluster Ti in the hot-rolled steel sheet, as described later, a coiling temperature CT is set to 600° C. or less. This coiling temperature CT comes close to a bainite transformation temperature for the aforementioned chemical composition. Therefore, the microstructure of the hot-rolled steel sheet of the present embodiment contains a large amount of bainite and also includes a large number of dislocations (transformation dislocations) that are introduced during bainite transformation. A transformation dislocation is a nucleation site of Ti carbo-nitrides. Therefore, an even greater amount of precipitation hardening can be obtained by the precipitation hardening heat treatment.

The area ratio of bainite can be adjusted by controlling the cooling history during hot rolling. A preferable lower limit of the area ratio of bainite is more than 70%. In this case, the strength of the tailored rolled blank can be further enhanced by precipitation hardening, and coarse cementite for which the cold formability is low decreases in the microstructure. Hence, the cold formability increases. A preferable upper limit of the area ratio of bainite is 90%.

The term "ferrite" as the balance in the microstructure that is mentioned above refers to polygonal ferrite (PF). More specifically, polygonal ferrite is a grain whose interior structure does not appear by etching using a nital reagent, and which also satisfies the formula $lq/dq<3.5$ when the circumferential length of the target grain is represented by lq and the circle-equivalent diameter thereof is represented by dq.

[Method of Measuring Area Ratio of Each Phase]

The area ratio of each phase in the aforementioned microstructure is measured by the following method. A sample is taken from the hot-rolled steel sheet. Of the total surface of the sample, a sheet-thickness cross section that is parallel to the rolling direction is taken as an observation surface. After polishing the observation surface, the observation surface is subjected to etching with nital. A visual field of 300 μm×300 μm of the observation surface after etching is photographed using an optical microscope to generate a structural photograph at a position at a depth equivalent to one-quarter of the sheet thickness. Image analysis is performed on the obtained structural photograph to determine the area ratio of ferrite (polygonal ferrite), the area ratio of pearlite, and the total area ratio of bainite and martensite, respectively.

In addition, another sample is taken from the hot-rolled steel sheet. On the surface of the sample, a sheet-thickness cross section that is parallel to the rolling direction is taken as the observation surface. The observation surface is subjected to LePera corrosion after polishing the observation surface. A visual field of 300 μm×300 μm of the observation surface after corrosion is photographed using an optical microscope to generate a structural photograph at a depth position equivalent to one-quarter of the sheet thickness. Image processing is performed on the obtained structural photograph to determine the total area ratio of retained austenite and martensite.

In addition, a different sample is prepared that is surface milled to a depth of one-quarter of the sheet thickness from a rolling surface normal direction. Of the entire sample surface, X-ray diffraction measurement is performed with respect to the surface that underwent surface milling, and the volume ratio of retained austenite is thereby determined. Since the volume ratio of retained austenite is equal to the area ratio of retained austenite, the obtained volume ratio of retained austenite is defined as the area ratio of the retained austenite.

The area ratio of bainite and the area ratio of martensite are determined based on the total area ratio of bainite and martensite, the total area ratio of retained austenite and martensite, and the area ratio of retained austenite that are obtained by the above described method.

The respective area ratios of ferrite, bainite, martensite, retained austenite and pearlite can be determined by the above described method.

[Number Density $N_0$ and Bake Hardening Amount (BH Amount) of Fine Ti Carbo-Nitrides in Hot-Rolled Steel Sheet]

Preferably, the Ti is dissolved or is in clusters in the hot-rolled steel sheet. In short, it is preferable that the amount of Ti carbo-nitride in the hot-rolled steel sheet is as small as possible. Ti carbo-nitrides having a particle diameter exceeding 10 nm (hereunder, referred to as "coarse Ti carbo-nitrides") does not contribute to strengthening of the hot-rolled steel sheet. On the other hand, if a large amount of Ti carbo-nitrides having a particle diameter of 10 nm or less (hereunder, referred to as "fine Ti carbo-nitrides") precipitates, the strength of the hot-rolled steel sheet will be too high. In this case, the rolling reaction force during cold rolling on the hot-rolled steel sheet becomes excessively high.

In addition, in a case where coarse Ti carbo-nitrides and fine Ti carbo-nitrides are formed in the hot-rolled steel sheet, even if a precipitation hardening heat treatment is performed on the steel sheet after cold rolling (cold-rolled steel sheet), it is difficult for Ti carbo-nitrides to be formed and thus precipitation hardening is not obtained. Therefore, in the hot-rolled steel sheet, it is preferable that the number of fine Ti carbo-nitrides and coarse Ti carbo-nitrides is small, and Ti is in a dissolved or clustered state.

In a case where a number density $n_0$ of fine Ti carbo-nitrides in the hot-rolled steel sheet is $1.0\times10^{17}$ per $cm^3$ or less, and a bake hardening amount (BH amount) is 15 MPa or more, Ti is adequately dissolved in the hot-rolled steel sheet or is present therein as cluster-shaped Ti carbo-nitrides. In this case, precipitation hardening does not occur in the hot-rolled steel sheet, and breaking elongation increases. Consequently, a rolling reaction force during cold rolling can be suppressed to a low amount, and cold formability increases. In addition, a large number of dislocations are introduced into the steel sheet by the decrease in the rolling reaction force. The introduced dislocations become precipitation sites of Ti carbo-nitrides during the precipitation hardening heat treatment after cold rolling. Therefore, a large amount of fine Ti carbo-nitrides precipitate, and the strength of the tailored rolled blank can be increased to 590 MPa or more. In addition, during the precipitation hardening heat treatment, restoration of dislocations occurs and the dislocation density decreases. As a result, the ductility of the tailored rolled blank increases. Therefore, the number density $n_0$ of fine Ti carbo-nitrides in the hot-rolled steel sheet is $1.0\times10^{17}$ per $cm^3$ or less, and the BH amount is 15 MPa or more.

[Method of Measuring Number Density No of Fine Ti Carbo-Nitrides]

The method of measuring the number density $n_0$ of the fine Ti carbo-nitrides is as follows. An acicular sample is prepared from the hot-rolled steel sheet by cutting and electropolishing. At this time, focused ion beam milling may be utilized together with electropolishing according to need. A three-dimensional distribution image of complex carbo-nitrides is acquired from the acicular sample by a three-dimensional atom probe measurement method.

According to the three-dimensional atom probe measurement method, integrated data can be reconstructed to acquire an actual three-dimensional distribution image of atoms in a real-space. With regard to measurement of the particle diameter of the Ti carbo-nitrides, a diameter when the relevant precipitate is regarded as a sphere is determined based on the number of atoms constituting the precipitate that is the observation object and the lattice constant thereof, and the diameter that is determined is defined as the particle diameter of the Ti carbo-nitride.

In the present description, particles having a particle diameter in a range from 0.5 to 10 nm among the Ti carbo-nitrides are defined as fine Ti carbo-nitrides. In a case where the particle diameter is less than 0.5 nm, because the particle diameter is less than the lattice constant of the Ti carbo-nitrides, the Ti carbo-nitrides cannot be regarded as a precipitate. The number density $n_0$ (particles/$cm^3$) is determined based on the number of fine Ti carbo-nitrides.

[Method of Measuring Bake Hardening Amount (BH Amount)]

The BH amount is an index that shows the amount of dissolved C. In a case where a large amount of coarse Ti carbo-nitrides precipitates, the BH amount in the hot-rolled steel sheet is low. In this case, an adequate amount of carbo-nitride precipitation is not obtained in the precipitation hardening heat treatment after cold rolling. If the BH amount in the hot-rolled steel sheet is 15 MPa or more, because the amount of coarse Ti carbo-nitrides contained in the hot-rolled steel sheet is sufficiently suppressed, the steel sheet after the precipitation hardening heat treatment is adequately hardened. A preferable BR amount is 25 MPa or more, and a more preferable BH amount is 30 MPa or more.

The method of measuring the BH amount is as follows. A JIS No. 5 tensile test specimen for which the rolling width direction is taken as the longitudinal direction is extracted from the hot-rolled steel sheet. A tension test is performed on the tensile test specimen, and given a tension prestrain of 4%. After being given the tension prestrain of 4%, the load is temporarily removed. The tensile test specimen from which the load is removed is subjected to heat treatment for 20 minutes at 180° C. The tensile test specimen after the heat treatment is subjected to a tension test once again. The BH amount is the margin of increase in the deforming stress at the time of the tension test after the heat treatment, and is determined by the following equation.

$$\text{BH amount (MPa)} = UYa\ \text{(MPa)} - FSb\ \text{(MPa)}$$

Where, UYa represents an upper yield point (MPa) when tension is reapplied after the heat treatment, and FSb represents the maximum deforming stress (MPa) when the tensile test specimen is given a tension prestrain of 4%.

[Crystal Orientation]

With respect to the hot-rolled steel sheet of the present embodiment, a range of a depth equivalent to three-eighths of the sheet thickness to a depth equivalent to five-eighths of the sheet thickness from the surface is defined as the "interior" of the hot-rolled steel sheet. A result of a crystal orientation measurement at a depth position (center portion) equivalent to one-half of the sheet thickness from the surface among the entire interior of the hot-rolled steel sheet is defined as the crystal orientation of the interior. On the other hand, a range from the surface to a depth equivalent to one-quarter of the sheet thickness is defined as an "outer layer" of the hot-rolled steel sheet. Further, a result of a crystal orientation measurement at center position of the "outer layer", that is, a position at a depth equivalent to one-eighth of the sheet thickness from the surface is defined as the crystal orientation of the outer layer. In the interior and the outer layer, the crystal orientation satisfies the following conditions.

[Crystal Orientation of Interior]

In the interior, an average value of pole densities D1 of a crystal orientation group (hereunder, referred to as "orientation group {100}<011> to {223}<110>") consisting of crystal orientations {100}<011>, {116}<110>, {114}<110>, {113}<110>, {112}<110>, {335}<110> and {223}<110> is four or less and a pole density D2 of a {332}<113> crystal orientation is 4.8 or less.

In short, in the interior of the hot-rolled steel sheet, the crystal orientation is made as random as possible to decrease the in-plane anisotropy. In a case where the average value of the pole densities D1 of the orientation group {100}<011> to {223}<110> is four or less and the pole density D2 of the {332}<113> crystal orientation is 4.8 or less, the in-plane anisotropy of the tensile strength and breaking elongation decreases. Specifically, a value of $|\Delta|$ that is an index of the in-plane anisotropy of the tensile strength and breaking elongation is less than 0.6. In this case, because the in-plane anisotropy is small, the dimensional accuracy (sheet thickness accuracy and sheet width accuracy) of an intermediate product after cold rolling increases, and excellent cold formability is obtained.

If the average value of the pole densities D1 of the orientation group {100}<011> to {223}<110> exceeds 4, or if the pole density D2 of the {332}<113> crystal orientation exceeds 4.8, the value of $|\Delta r|$ becomes 0.6 or more, and the in-plane anisotropy becomes too large. In such case, the cold formability decreases. A preferable upper limit of the average value of the pole densities D1 of the orientation group {100}<011> to {223}<110> is 3.5. A further preferable upper limit is 3.0. A preferable upper limit of the pole density D2 of the {332}<113> crystal orientation is 4.0. A further preferable upper limit is 3.0.

[Crystal Orientation of Outer Layer]

On the other hand, in the outer layer, a pole density D3 of a {110}<001> crystal orientation is 2.5 or more. In short, although the crystal orientation is made as random as possible in the interior, in the outer layer the proportion thereof that is occupied by the {110}<001> crystal orientation as a specific crystal orientation is made as high as possible.

In plastic deformation (rolling deformation) of a bcc metal, for grains of the {110}<001> crystal orientation, there are few active slip systems and the orientation is not susceptible to work hardening. When producing a tailored rolled blank, the reduction is partially changed during cold rolling to produce a thick-wall portion and a thin-wall portion in the steel sheet. Accordingly, the reduction during the cold rolling differs between a thick-wall portion and a thin-wall portion. If the reductions are different, the amount of strain that is introduced will also be different. Therefore, a difference in work hardening arises between a thick-wall portion and a thin-wall portion, and thus a difference arises in the hardness. A difference in the hardness is liable to arise, in particular, between the outer layer portions of a thick-wall portion and a thin-wall portion. In a case where the hardness of a steel sheet differs depending on the region, the cold formability of a tailored rolled blank decreases. Accordingly, it is preferable to make a hardness difference as small as possible.

As described above, the grains of the {110}<001> crystal orientation are not susceptible to work hardening. Further, as described later, in the present embodiment the cold-rolling rate is in a range from more than 5 to 50%. In this case, even after cold rolling, the {110}<001> crystal orientation remains in the outer layer. Therefore, in the outer layer of the hot-rolled steel sheet, if the pole density of the {110}<001> crystal orientation is high, specifically, if the pole density D3 of the {110}<001> crystal orientation is 2.5 or more, a hardness difference between a thick-wall portion and thin-wall portion of the tailored rolled blank can be reduced, and a variation in the hardness can be suppressed. As a result, the cold formability of the tailored rolled blank increases.

If the pole density D3 of the {110}<001> crystal orientation is less than 2.5, the hardness difference between a thick-wall portion and a thin-wall portion of the tailored rolled blank becomes large. A preferable lower limit of the pole density of the {110}<001> crystal orientation is 3.0, and further preferably is 4.0.

The term "pole density" refers to a value that indicates how many times higher the degree of accumulation of a test sample is relative to a reference sample that generally does not have accumulation in a specific orientation. In the embodiment of the present invention, values measured by an EBSP (Electron Back Scattering Pattern) method are used for the pole densities described hereunder.

Measurement of a pole density by the EBSP method is performed as follows. A cross-section parallel to the rolling direction of the hot-rolled steel sheet is adopted as the observation surface. Of the entire observation surface, a rectangular region of 1000 μm in the rolling direction and 100 μm in the rolling surface normal direction that is centered on a depth position (t/8) that is equivalent to one-eighth of a sheet thickness t from the steel sheet surface is defined as an outer layer region. Similarly, a rectangular region of 1000 μm in the rolling direction and 100 μm in the rolling surface normal direction that is centered on a depth position (t/2) that is equivalent to one-half of the sheet thickness t from the steel sheet surface is defined as an interior region. EBSD analysis is performed at measurement intervals of 1 μm with respect to the outer layer region and interior region to acquire crystal orientation information.

The EBSD analysis is carried out at an analysis speed of 200 to 300 points per second using an apparatus constituted by a thermal field emission scanning electron microscope (JSM-7001F; manufactured by JEOL Ltd.) and an EBSD detector (Hikari detector; manufactured by TSL). An ODF (orientation distribution function) is calculated with respect to the measured crystal orientation information using EBSD analysis software "OIM Analysis (registered trademark)". By this means, the pole density of each crystal orientation can be determined.

Figure 1B:
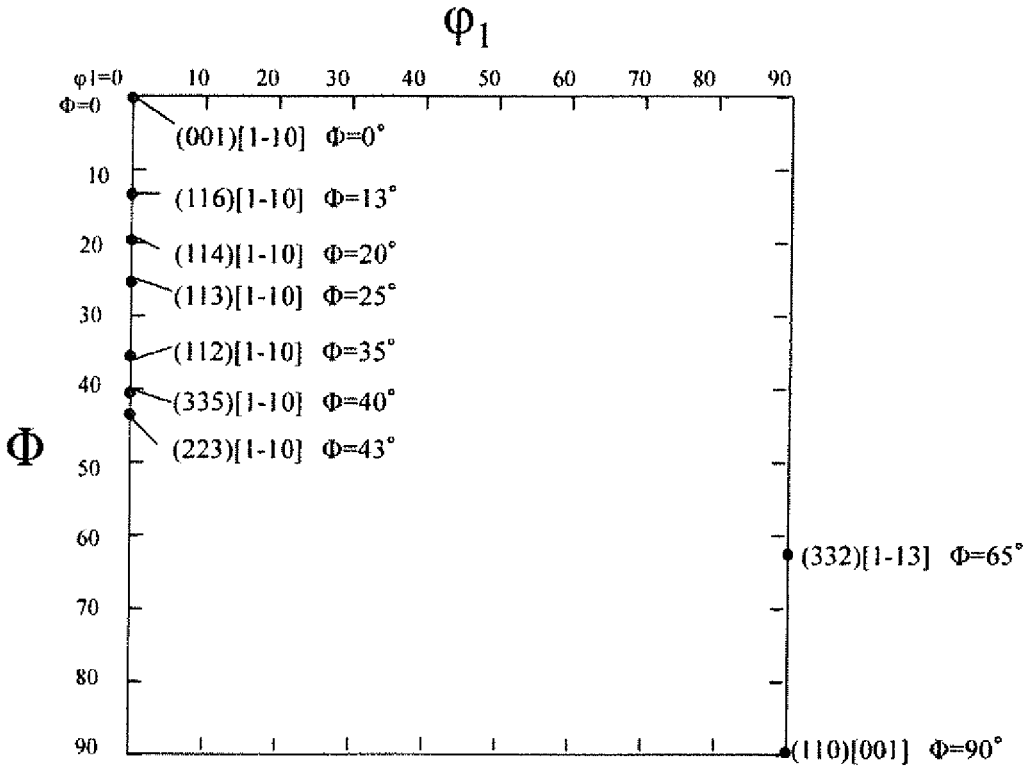
FIG. 1B is a view illustrating main crystal orientation positions on a φ2=45° section in the Euler space shown in FIG. 1A.

FIG. 1A is a schematic diagram of Euler space that takes angular variables $\varphi 1$, $\varphi 2$ and $\Phi$ as rectangular coordinates in an ODF (orientation distribution function), and FIG. 1B is a view illustrating main crystal orientation positions on a φ2=45° section in the Euler space shown in FIG. 1A. Regarding the orientations, normally, crystal orientations perpendicular to a sheet plane are represented by (hkl) or {hkl}, and crystal orientation parallel to the rolling direction are represented by [uvw] or <uvw>. The terms {hkl} and <uvw> represent collective terms for equivalent planes, and (hkl) and [uvw] represent individual crystal planes.

The crystalline structure of the hot-rolled steel sheet of the present embodiment is a body-centered cubic structure (bcc structure). Therefore, for example, (111), (−111), (1−11), (11−1), (−1−11), (−11−1), (1−1−1) and (−1−1−1) are equivalent and cannot be distinguished from each other. These orientations are collectively called {111}.

Note that, ODF is also used for representing crystal orientations of low-symmetry crystalline structures. In general, such crystal orientations are represented by φ1=0 to 360°, Φ=0 to 180°, and φ2=0 to 360°, and individual crystal orientations are represented by (hkl)[uvw]. However, the crystalline structure of the hot-rolled steel sheet of the present embodiment is a body-centered cubic structure that has a high degree of symmetry. Therefore, Φ and φ2 can be represented with 0 to 90°.

When performing a calculation, φ1 changes according to whether or not symmetry caused by deformation is taken into account. In the present embodiment, a calculation that takes symmetry (orthotropic) into account is performed, and is represented by φ1=0 to 90°. That is, for the hot-rolled sheet according to the present embodiment, a method is selected that represents average values of identical orientations for φ1=0 to 360° on an ODF of 0 to 90°. In this case, (hkl)[uvw] and {hkl}<uvw> are synonymous. Therefore, for example, a random strength ratio of an (001)[1-10] orientation of the ODF at a φ2=45° cross-section that is shown in FIG. 1 is synonymous with the pole density of an {001}<120> orientation.

[Method for Producing Hot-Rolled Steel Sheet for a Tailored Rolled Blank]

An example of the method for producing a hot-rolled steel sheet for a tailored rolled blank that is described above will now be described. The method for producing a hot-rolled steel sheet for a tailored rolled blank according to the present embodiment includes a casting process and a hot rolling process. Hereunder, each process is described.

[Casting Process]

Molten steel is produced by a melting process using a shaft furnace, a converter, an electric furnace or the like, and the molten steel is then adjusted by various kinds of secondary refining processes so as to satisfy the aforementioned chemical composition and Formula (1). The molten steel that is produced is used to produce a slab by normal continuous casting, casting by an ingot method, or a thin slab casting method or the like. Note that, scrap may also be used for the raw material of the molten steel. In a case where a slab is obtained by continuous casting, a high-temperature slab may be directly transferred as it is to a hot rolling mill, or the slab may be cooled to room temperature and thereafter reheated in a heating furnace and subjected to hot rolling.

[Hot Rolling Process]

Hot rolling is carried out using the produced slab to thereby produce a hot-rolled steel sheet. The hot rolling process includes a heating step (S1), a rough rolling step (S2), a finish rolling step (S3), a cooling step (S4) and a coiling step (S5).

In the hot-rolled steel sheet of the present embodiment, precipitation of Ti carbo-nitrides is suppressed as much as possible, and the Ti is dissolved or the Ti carbo-nitride is placed in a clustered state. In addition, the pole density D1 of the interior orientation group {100}<011> to {223}<110> and the pole density D2 of the {332}<113> crystal orientation is reduced, and the pole density D3 of the {110}<001> crystal orientation of the outer layer is increased. By this means, the in-plane anisotropy of the hot-rolled steel sheet is reduced, and the cold formability of the hot-rolled steel sheet is increased. Furthermore, a hardness difference between a thick-wall portion and a thin-wall portion of the tailored rolled blank is decreased, and the cold formability of the tailored rolled blank is also increased. The respective steps are described in detail below.

[Heating Step (S1)]

First, the slab is heated in a heating furnace (heating step). The respective conditions in the heating step are as follows.

Heating temperature $T_{S1}$: not less than temperature $SRT_{min}$ (° C.) defined by Formula (2)

Heat the slab at the heating temperature $T_{S1}$ that is not less than the heating temperature $SRT_{min}$ (° C.) defined by Formula (2).

$$SRT_{min}=10780/\{5.13-\log([Ti]\times[C])\}-273 \quad (2)$$

The content of the corresponding element is substituted for the respective symbols of elements in Formula (2).

If the heating temperature $T_{S1}$ is less than $SRT_{min}$, coarse Ti carbo-nitrides in the slab do not dissolve sufficiently. In this case, a large amount of coarse Ti carbo-nitrides remain inside the hot-rolled steel sheet, and as a result the BH amount decreases. Consequently, the strength of the hot-rolled steel sheet decreases. In addition, an effect of precipitation hardening by the precipitation hardening heat treatment is not adequately obtained. If the heating temperature is $SRT_{min}$ or more, formability is adequately obtained at a time of cold rolling and the tensile strength of the tailored rolled blank is increased by precipitation hardening. A preferable lower limit of the heating temperature for further increasing the operational efficiency is 1100° C.

Heating Time Period $t_{S1}$ at Temperature $SRT_{min}$ or More: 30 Minutes or More A heating time period $t_{S1}$ after the heating temperature becomes $SRT_{min}$ or more is 30 minutes or more. In this case, Ti carbo-nitrides can be sufficiently dissolved. A preferable heating time period $t_{S1}$ is 60 minutes or more. In this case, the slab can be evenly heated to a sufficient degree in the thickness direction thereof. A preferable heating time period $t_{S1}$ is not more than 240 minutes. In this case, excessive generation of scale can be suppressed, and a decrease in the yield can be suppressed.

Note that, after casting the slab may also be directly transferred as it is without being reheated to a roughing mill, described later, to perform rough rolling.

[Rough Rolling Step (S2)]

Rough rolling is promptly carried out on the slab extracted from the heating furnace to thereby produce a rough bar. The conditions for rough rolling are as follows.

Number of Passes in which Specific Rolling is Performed SPN: 1 or More

In the rough rolling, rolling in which the reduction 20% or more and the slab temperature is in a range from 1050 to 1150° C. is defined as "specific rolling". In the rough rolling, specific rolling is performed one time (one pass) or more. That is, the number of passes (specific passes number) SPN in which specific rolling is performed is one or more.

If the slab temperature during rough rolling is less than 1050° C., the deformation resistance of the slab becomes excessively high, and hence an excessive load is applied to the roughing mill. On the other hand, if the slab temperature during rough rolling is more than 1150° C., secondary scale that is generated during rough rolling grows too much and it may not be possible to adequately remove the scale during descaling that is performed after the rough rolling. Furthermore, if the reduction for a single pass is too low, there will be insufficient resolution of the segregation of precipitation elements caused by grain refinement of grains that utilizes the working of austenite and subsequent recrystallization thereof as well as the solidification structure. In this case, in steps from the finish rolling step onward, Ti carbo-nitrides are liable to coarsely precipitate. Therefore, even if a precipitation hardening heat treatment is performed on the intermediate product produced by cold rolling, the precipitation hardening will be uneven and the formability will decrease. Therefore, the specific passes number SPN is set to one or more.

Note that, in a ease where the slab obtained after casting is directly transferred as it is in a high temperature state without being heated and rough rolling is performed thereon, a cast structure remains, and in some cases precipitation hardening in a precipitation hardening heat treatment performed on the tailored rolled blank is inhomogeneous and the cold formability decreases. Therefore, preferably the slab is heated in the aforementioned heating step (S1).

Total Passes Number TPN for Rough Rolling: 2 or More

The number of rolling passes in the rough rolling is not less than two (multiple times). That is, a total passes number TPN for which rough rolling is performed is two or more. By performing rough rolling multiple times, working and recrystallization of austenite are repeated, and the average particle diameter of austenite grains before finish rolling can be made 100 μm or less. In this case, in the precipitation hardening heat treatment, homogeneous precipitation hardening can be stably achieved. If the total passes number TPN is too high, the productivity decreases. Further, the temperature of the rough bar becomes excessively low. Therefore, a preferable upper limit of the total passes number TPN is 11.

Overall Reduction $R_{S2}$: 60 to 90%

In a case of performing a plurality of rough rolling passes, an overall reduction $R_{S2}$ for the rough rolling is from 60 to 90%. If the overall reduction $R_{S2}$ is less than 60%, inhomogeneousness with respect to the austenite particle diameter and segregation in the steel sheet is not adequately resolved, and a large number of coarse Ti carbo-nitrides precipitate. As a result, the strength of the hot-rolled steel sheet decreases, and the BH amount also decreases. On the other hand, if the overall reduction $R_{S2}$ is more than 90%, the effect thereof saturates. In addition, because the number of passes increases when the overall reduction $R_{S2}$ increases, the productivity decreases and the temperature of the rough bar also decreases.

[Finish Rolling Step (S3)]

Finish rolling is performed on a rough bar produce by rough rolling. The respective conditions for the finish rolling are as follows.

Time Period $t_{S3}$ from after End of Rough Rolling Until Start of Finish Rolling: 150 Seconds or Less The time period $t_{S3}$ from after the end of rough rolling until the start of finish rolling is 150 seconds or less. If the time period $t_{S3}$ is more than 150 seconds, in the rough bar, Ti that dissolved in the austenite precipitates as coarse Ti carbo-nitrides and the BH amount becomes less than 15 MPa. In this case, because the Ti carbo-nitride amount that contributes to precipitation hardening after the precipitation hardening heat treatment decreases, the tensile strength of the tailored rolled blank is less than 590 MPa.

Furthermore, if the time period $t_{S3}$ is more than 150 seconds, grain growth of austenite progresses prior to finish rolling, and the average particle diameter of austenite grains prior to finish rolling coarsens to more than 100 μm. As a result, homogeneity of precipitation hardening during the precipitation hardening heat treatment decreases.

A lower limit of the time period $t_{S3}$ is not particularly limited. However, a preferable lower limit of the time period $t_{S3}$ is 30 seconds. As described later, a rolling starting temperature for the finish rolling is less than 1080° C. If the time period $t_{S3}$ is too short, a cooling apparatus must be disposed between the roughing mill and the finish rolling mill to make the starting temperature for the finish rolling less than 1080° C. If the time period $t_{S3}$ is 30 seconds or more, even if a cooling apparatus is not provided, the temperature of the rough bar becomes less than 1080° C. by air cooling.

Finish Rolling Starting Temperature $T_{S3}$: 1000° C. to Less than 1080° C.

The temperature (finish rolling starting temperature $T_{S3}$) of the rough bar when starting finish rolling is in a range from 1000° C. to less than 1080° C. If the temperature $T_{S3}$ is less than 1000° C., Ti precipitates in austenite as coarse Ti carbo-nitrides due to strain-induced precipitation during the finish rolling, and the BH amount decreases. Consequently, the amount of Ti carbo-nitrides that precipitates at the time of the precipitation hardening heat treatment decreases. On the other hand, if the temperature $T_{S3}$ is higher than 1080° C., blisters arise between the surface scale of ferrite of the steel sheet before finish rolling and during respective roll stands (between passes) of the finish rolling mill. Blisters are the starting point of fish-scale defects and spindle-shaped scale. Therefore, these scale defects are liable to arise.

Finish Rolling Ending Temperature FT: $Ar_3$ Transformation Point Temperature to 1000° C.

A finish rolling ending temperature FT is in a range from an $Ar_3$ transformation point temperature to 1000° C. If the temperature FT is less than the $Ar_3$ transformation point temperature, it is difficult for bainite to form, and the area ratio of bainite in the hot-rolled steel sheet is less than 20%. Therefore, not only does the formability of the hot-rolled steel sheet decrease, the anisotropy of the aggregate structure increases in the hot-rolled steel sheet. In addition coarse Ti carbo-nitrides increase, and as a result the BH amount decreases. On the other hand, if the temperature FT is more than 1000° C., precipitation of fine Ti carbo-nitrides progresses during cooling after finish rolling, and the number density $n_0$ of fine Ti carbo-nitrides in the hot-rolled steel sheet is more than $1.0\times10^{17}$ per $cm^3$. As a result, the amount of fine Ti carbo-nitrides that precipitates during precipitation hardening heat treatment is insufficient, and the cold formability during cold rolling decreases.

The $Ar_3$ transformation point temperature is defined, for example, by the following Formula (I).

$$Ar_3=910-310\times[C]+25\times\{[Si]+2\times[Al]\}-80\times[M_{neq}] \quad (I)$$

A content (mass %) of the corresponding element is substituted for the respective symbols of elements in Formula (I). In a case where boron (B) is not contained, $[M_{neq}]$ is defined by Formula (II), while in a case where B is contained, $[M_{neq}]$ is defined by Formula (III).

$$[M_{neq}]=[Mn]+[Cr]+[Cu]+[Mo]+[Ni]/2+10([Nb]-0.02) \quad (II)$$

$$[M_{neq}]=[Mn]+[Cr]+[Cu]+[Mo]+[Ni]/2+10([Nb]-0.02)+1 \quad (III)$$

Overall Reduction $R_{S3}$ of Finish Rolling: 75 to 95%

The finish rolling is, for example, rolling in which a plurality of passes are performed by a tandem rolling mill. An overall reduction $R_{S3}$ during the finish rolling is from 75 to 95%. In the finish rolling, although recrystallization occurs between rolling passes, recrystallization does not occur during rolling. Therefore, if a plurality of rolling passes are performed, recrystallization and non-recrystallization are repeatedly performed. In this case, austenite grains are subjected to grain refinement and bainite in the microstructure can be dispersed in an island shape. As a result, a decrease in the formability of the hot-rolled steel sheet can be suppressed.

However, if the overall reduction $R_{S3}$ is less than 75%, austenite grains cannot be sufficiently refined and become inhomogeneous, and bainite in the microstructure is arranged continuously in a row shape. In addition, a large amount of coarse Ti carbo-nitrides precipitates and the BH amount decreases. In this case, the cold formability of the hot-rolled steel sheet decreases. On the other hand, if the overall reduction $R_{S3}$ is more than 95%, not only does the aforementioned effect saturate, but an excessive load is placed on the rolling mill. Therefore, the overall reduction $R_{S3}$ is in a range from 75 to 95%.

Preferably, the reduction in each pass is 10% or more. If the growth of grains progresses excessively between rolling passes and after the end of finish rolling, in some cases the toughness of the hot-rolled steel sheet decreases. Therefore, preferably the average reduction in the final three passes of the finish rolling mill is 10% or more.

Total Reduction $R_{f2}$ of Final Two Passes: 30% or More

A total reduction $R_{F2}$ of the final two passes is 30% or more. When the total reduction $R_{F2}$ is 30% or more and the finish rolling ending temperature FT is not less than the $Ar_3$ transformation point, recrystallization of austenite can be promoted and rotation of the crystal orientation is reset. Therefore, in the hot-rolled steel sheet interior, the average of the pole densities D1 of the orientation group {100}<011> to {223}<110> becomes 4 or less, and the pole density D2 of {332}<113> becomes 4.8 or less. In this case, the |Δr| value of the hot-rolled steel sheet becomes 0.6 or less, and the in-plane anisotropy decreases. On the other hand, if the total reduction $R_{F2}$ is less than 30%, recrystallization of austenite is insufficient, and consequently the |Δr| value of the hot-rolled steel sheet is more than 0.6.

Preferably, the total reduction $R_{F2}$ is 30% or more, and the finish rolling ending temperature FT is not less than the $Ar_3$ transformation point temperature +50° C. In this case, recrystallization is promoted in the austenite.

Shape Ratio SR: 3.5 or More

The shape ratio SR is defined by the following Formula (3).

$$\text{Shape ratio SR}=ld/hm \quad (3)$$

Where, ld represents a length of an arc of contact between a rolling roll (final roll) that performs a final rolling reduction in the finish rolling and the steel sheet, and is defined by the following formula.

$$ld=\sqrt{(L\times(h_{in}-h_{out})/2)}$$

Where, L (mm) represents the diameter of the aforementioned rolling roll. Further, $h_{in}$ represents the sheet thickness (mm) of the steel sheet on the aforementioned rolling roll entrance side, and $h_{out}$ represents the sheet thickness of the steel sheet on the aforementioned rolling roll exit side.

hm is defined by the following formula:

$$hm=(h_{in}+h_{out})/2$$

If the shape ratio SR is 3.5 or more, sufficient shearing strain can be imparted to the outer layer of the steel sheet during hot rolling. In this case, the pole density D3 of the {110}<001> crystal orientation of the outer layer of the hot-rolled steel sheet can be made 2.5 or more, and a hardness difference between a thick-wall portion and a thin-wall portion of the tailored rolled blank can be reduced.

Preferable Rolling Speed FV of Final Finishing Pass: 400 Mpm or More

The rolling speed in the finish rolling is not particularly limited. However, if a time period between each pass of the finish rolling is too long, in some cases the austenite grains in the steel sheet coarsen and the toughness of the hot-rolled steel sheet decreases. Accordingly, the rolling speed FV of the final finishing pass is preferably 400 mpm or more. A more preferable lower limit of the rolling speed FV is 650 mpm. In this case, bainite disperses in an island shape, and hence the formability of the hot-rolled steel sheet is further enhanced. An upper limit of the rolling speed FV is not particularly limited. However, due to facility constraints, the upper limit of the rolling speed FV is, for example, 1800 mpm.

[Cooling Step (S4)]

After completion of the finish rolling, in order to elaborate the microstructure of the hot-rolled steel sheet, cooling that is optimized by control of a run-out-table is performed (cooling step). In the hot rolling process (rough rolling and finish rolling), the microstructure of the steel sheet is austenite. Therefore, in the hot rolling process, precipitation of coarse Ti carbo-nitrides by strain-induced precipitation is suppressed. On the other hand, in a cooling step and a coiling step after the hot rolling process, the microstructure of the steel sheet transforms from austenite to ferrite. Accordingly, in these steps, the temperature history of the hot-rolled steel sheet is adjusted so that precipitation of Ti carbo-nitride inside ferrite can be suppressed. Specifically, the respective conditions in the cooling step are as follows.

Time Period $t_{S4}$ Until Starting Cooling after Finish Rolling Ends: 3 Seconds or Less After the finish rolling ends, a time period $t_{S4}$ until starting cooling is 3 seconds or less. If the time period $t_{S4}$ is more than 3 seconds, in the pre-transformation austenite, precipitation of coarse Ti carbo-nitrides progresses, and as a result the amount of dissolved C decreases and the BH amount decreases. In this case, the tensile strength of the hot-rolled steel sheet decreases, and the tensile strength of the tailored rolled blank decreases. Furthermore, if the time period $t_{S4}$ is more than 3 seconds, austenite grains in the hot-rolled steel sheet coarsen, and bainite in the microstructure is arranged continuously in a row shape. In this case, the formability of the hot-rolled steel sheet decreases. Therefore, the time period $t_{S4}$ is 3 seconds or less.

A lower limit of the time period $t_{S4}$ is not particularly limited. However, if the time period $t_{S4}$ is too short, cooling is performed in a state where a layered worked structure obtained by rolling remains, and bainite that is continuously arranged in a row shape is obtained. In this case, the formability of the hot-rolled steel sheet may decrease. Therefore, a preferable lower limit of the time period $t_{S4}$ is 0.4 seconds.

Average Cooling Rate CR: 15° C./Sec or More

An average cooling rate CR until a cooling stopping temperature is 15° C./sec or more. If the average cooling rate CR is less than 15° C./sec, pearlite is formed during cooling, and an intended microstructure is not obtained. Furthermore, if the average cooling rate CR is too slow, a large amount of fine Ti carbo-nitrides precipitate, and the number density $n_0$ of the fine Ti carbo-nitrides is more than $1.0\times10^{17}$ per $cm^3$. On the other hand, if the average cooling rate CR is too fast, it becomes difficult to control the cooling stopping temperature, and it is difficult to obtain an intended microstructure. Therefore, a preferable upper limit of the average cooling rate CR is 150° C./sec.

Cooling Stopping Temperature $T_{S4}$: 600° C. or Less

A cooling stopping temperature $T_{S4}$ is 600° C. or less. If the cooling stopping temperature $T_{S4}$ is more than 600° C., after coiling, precipitation of Ti carbo-nitrides is liable to progress in post-transformation ferrite, and the number density $n_0$ of fine Ti carbo-nitrides in the hot-rolled steel sheet becomes more than $1.0\times10^{17}$ per $cm^3$ and the BH amount also decreases. As a result, the amount of Ti carbo-nitrides that precipitate as a result of the precipitation hardening heat treatment decreases, and the tensile strength of the tailored rolled blank is reduced. If the cooling stopping temperature $T_{S4}$ is 600° C. or less, in the microstructure of the hot-rolled steel sheet the area ratio of bainite becomes 20% or more and the balance is mainly ferrite. In addition, the number density $n_0$ of fine Ti carbo-nitrides in the hot-rolled steel sheet is not more than $1.0\times10^{17}$ per $cm^3$, and the Ti in the hot-rolled steel sheet dissolves or becomes a cluster shape.

A preferable upper limit of the cooling stopping temperature $T_{S4}$ is 550° C. In this case, in the microstructure of the hot-rolled steel sheet, the area ratio of bainite increases further.

If the cooling stopping temperature $T_{S4}$ is too low, since a coil is maintained in a wet state for a long time period, the surface properties decrease. Therefore, a preferable lower limit of the cooling stopping temperature $T_{S4}$ is 50° C. To reduce a rolling reaction force during cold rolling, a further preferable lower limit of the cooling stopping temperature $T_{S4}$ is 450° C.

Total Cumulative Diffusion Length $L_{total}$ in Time Period Until Coiling Starts after Steel Sheet Temperature Passes $Ar_3$ Transformation Temperature: 0.15 μm or Less In order to suppress the precipitation amount of Ti carbo-nitrides in the hot-rolled steel sheet, a length (total cumulative diffusion length $L_{total}$) that Ti diffuses in a time period from a time when the temperature of the steel sheet becomes the $Ar_3$ transformation temperature until coiling is started (that is, a time period in which ferrite is formed) is restricted.

A diffusion length of Ti in ferrite is taken as "L", a volume diffusion coefficient at a temperature T° C. is taken as "D(T+273)", and a diffusion time period is taken as "t". At this time, the diffusion length L is defined by the following formula.

$$L=\sqrt{(D(T)\times t)} \quad \text{(IV)}$$

D(T) in Formula (IV) is defined by Formula (4) using a diffusion coefficient D0 of Ti, an activation energy Q and a gas constant R.

$$D(T)=D0\times\mathrm{Exp}\{-Q/R(T+273)\}$$

The total cumulative diffusion length $L_{total}$ of Ti in ferrite is the accumulation of diffusion lengths L in a very small time period $\Delta t_L$ (sec) in a time period from a time that the temperature of the steel sheet becomes the $Ar_3$ transformation temperature until coiling starts. In the present description, the aforementioned very small time period $\Delta t_L$ is 0.2 seconds. Accordingly, the total cumulative diffusion length $L_{total}$ is defined by Formula (4).

$$L_{total}=\Sigma\sqrt{(D(T)\times\Delta t_L)} \quad (4)$$

If the total cumulative diffusion length $L_{total}$ of Ti in ferrite that is determined by Formula (4) is more than 0.15 μm, precipitation of Ti carbo-nitrides is promoted during cooling. In this case, because the amount of precipitation of Ti carbo-nitrides caused by the precipitation hardening heat treatment decreases, the tensile strength of the tailored rolled blank decreases. Therefore, the total cumulative diffusion length $L_{total}$ is 0.15 μm.

[Coiling Step (S5)]

After cooling stops, the hot-rolled steel sheet is coiled. A temperature (coiling temperature) CT when starting coiling of the hot-rolled steel sheet is 600° C. or less. If the coiling temperature is more than 600° C., precipitation of Ti carbo-nitrides is promoted during coiling, and the number density $n_0$ of fine Ti carbo-nitrides in the hot-rolled steel sheet is more than $1.0\times10^{17}$ per $cm^3$, and the BH amount also decreases. Therefore, the coiling temperature CT is 600° C. or less. A preferable upper limit of the coiling temperature CT is 500° C.

By performing the above described steps, the hot-rolled steel sheet of the present embodiment is produced.

[Other Steps]

For the purpose of straightening the shape of the hot-rolled steel sheet, skin pass rolling with a reduction in a range from 0.1 to 5% may be performed after all of the above described steps are completed.

Further, a step for removing scale that adheres to the surface of the hot-rolled steel sheet may be performed. In the step for removing scale, general pickling may be performed using hydrochloric acid or sulfuric acid, or surface grinding by means of a sander or the like may be performed. Surface scarfing utilizing plasma or a gas burner or the like may also be performed. These treatments may be performed in combination.

[Tailored Rolled Blank]

In the tailored rolled blank of the present embodiment, the sheet thickness changes in a tapered shape in the rolling direction. The tailored rolled blank includes a thick-wall portion that is a portion at which the sheet thickness is thick, and a thin-wall portion at which the sheet thickness is thinner than the thick-wall portion. The tailored rolled blank is produced using the hot-rolled steel sheet of the present embodiment that is described above. The tailored rolled blank of the present embodiment has the following characteristics.

Hardness Ratio $HR=H_{t\ max}/H_{t\ min}$: 1.0 or More to 1.5

The tailored rolled blank is formed in a final product shape by cold working such as pressing. As described above, the tailored rolled blank includes portions at which the sheet thicknesses are different (thick-wall portion and thin-wall portion). If there is a large hardness difference between a thick-wall portion and a thin-wall portion, the cold formability of the tailored rolled blank decreases. In such a case, a part of the tailored rolled blank may break off during cold working using the tailored rolled blank to form the final product.

With respect to the tailored rolled blank of the present embodiment, a hardness ratio HR of an average hardness $H_{t\ max}$ of a portion at which the sheet thickness is thickest (referred to as "thickest wall portion") with respect to an average hardness $H_{t\ min}$ of a portion at which the sheet thickness is thinnest (referred to as "thinnest wall portion") (that is, the hardness ratio $HR=H_{t\ max}/H_{t\ min}$) is in a range of more than 1.0 to 1.5. If the hardness ratio HR is 1.0 or less, the hardness of the thin-wall portion is too high relative to the hardness of the thick-wall portion. In such a case, the cold formability of the tailored rolled blank decreases, and in some cases a rupture occurs at a thin-wall portion during cold working into a final product. On the other hand, if the hardness ratio HR is more than 1.5, the hardness of the thick-wall portion is too high relative to the hardness of the thin-wall portion. In this case also, the formability of the tailored rolled blank decreases. Specifically, even if a ratio ($TH_{min}/TH_{max}$) of the sheet thickness $TH_{min}$ of the thinnest wall portion to the sheet thickness $T_{max}$ of the thickest wall portion is increased to around 0.6, a rupture sometimes occurs in the thick-wall portion. Therefore, the hardness ratio HR is in a range from more than 1.0 to 1.5. A preferable lower limit of the hardness ratio HR is 1.2. A preferable upper limit of the hardness ratio HR is 1.4.

The hardness ratio HR is measured by the following method. At a cross-section in the sheet thickness direction of the thickest wall portion of the tailored rolled blank, the hardness is measured at a center position in the sheet thickness of the thickest wall portion, at a position at a depth of ¼ of the sheet thickness from the surface, and at a position at a depth of ¾ of the sheet thickness from the surface. The hardness is determined by a Vickers hardness test in accordance with JIS Z2244 (2009). The test force is set as 98.07 N. An average of the measurement results at the three points is defined as the average hardness $H_{t\ max}$ (HV). Similarly, at a cross-section in the sheet thickness direction of the thinnest wall portion, the hardness is measured at a center position in the sheet thickness of the thinnest wall portion, at a position at a depth of ¼ of the sheet thickness from the surface, and at a position at a depth of ¾ of the sheet thickness from the surface, and the average of the obtained values is defined as the average hardness $H_{t\ min}$ (HV). The hardness ratio HR is determined using the obtained average hardnesses $H_{t\ max}$ and $H_{t\ min}$.

Average Dislocation Density ρ at Thinnest Wall Portion: $1\times10^{14}$ $m^{-2}$ or Less Excellent cold formability is sought, in particular, at the thinnest wall portion of the tailored rolled blank. If an average dislocation density ρ of the thinnest wall portion is too high, the cold formability of the thinnest wall portion decreases, and the thinnest wall portion is liable to rupture when forming a final product by cold working. Therefore, the average dislocation density ρ at the thinnest wall portion is $1\times10^{14}$ $m^{-2}$ or less. A preferable average dislocation density ρ is $5\times10^{14}$ $m^{-2}$.

The average dislocation density ρ of the thinnest wall portion is measured by the following method. A sample is extracted that includes a cross-section in the sheet thickness direction of the thinnest wall portion. Using the sample, the average dislocation density ρ is calculated based on a half-value width of (110), (211) and (220). Specifically, X-ray diffractometry (XRD) is performed using the sample, and half-value widths at diffraction peaks of (110), (200) and (211) are determined, respectively. An average dislocation density ρ ($m^{-2}$) is defined based on the half-value widths at each individual crystal plane. Specifically, a strain ε is determined according to the Williamson-Hall method (Non Patent Literature 1: G. K. Williams and W. H. Hall: Act. Metall., 1 (1953), 22) based on the half-value width. Based on the determined strain ε and a Burgers vector b (b=0.25 nm) of iron, the average dislocation density ρ is determined by using $\rho=14.4\varepsilon^2/b^2$ (Non Patent Literature 2: G. K. Williams and R. E. Smallman: Philos. Mag., 8 (1956), 34).

Number Density $n_1$ of Fine Ti Carbo-Nitrides (Ti(C, N)): More than $2\times10^{17}$ Per $cm^3$ The generation of Ti carbo-nitrides in the hot-rolled steel sheet that serves as the raw material is suppressed as much as possible. On the other hand, high strength (590 MPa or more in terms of tensile strength) is sought in the tailored rolled blank. Therefore, by performing the precipitation hardening heat treatment that is described later, a large amount of fine Ti carbo-nitrides (Ti carbo-nitrides having a particle diameter of 10 nm or less) is generated in the tailored rolled blank to thereby increase the strength thereof.

In the tailored rolled blank of the present embodiment, a number density $n_1$ of fine Ti carbo-nitrides having a particle diameter of 10 nm or less is more than $2\times10^{17}$ per $cm^3$. In this case, the precipitation hardening is sufficient, and the tensile strength of the tailored rolled blank is 590 MPa or more. A preferable lower limit of the number density $n_1$ is $5\times10^{15}$ per $cm^3$.

The number density $n_1$ is determined by a similar method as the number density $n_0$. Specifically, a sample is extracted from a center portion with respect to the sheet thickness of the tailored rolled blank. The number density $n_1$ is then determined by the same method as the number density $n_0$ using the extracted sample. That is, the particle diameters of the fine Ti carbo-nitrides are in a range from 0.5 to 10 nm.

The tailored rolled blank of the present embodiment has the above described characteristics. Thus, the tailored rolled blank has high strength (tensile strength of 590 MPa or more), and irrespective of having a thick-wall portion and a thin-wall portion, exhibits excellent cold formability.

A galvanized layer or an alloyed galvanized layer may be formed on the surface of the tailored rolled blank of the present embodiment.

[Method for Producing Tailored Rolled Blank]

One example of a method for producing the above described tailored rolled blank will now be described. The present method for producing a tailored rolled blank uses the above described hot-rolled steel sheet. The present method for producing a tailored rolled blank includes a cold rolling step (S6) and a precipitation hardening heat treatment step (S7). Each production step is described in detail hereunder.

[Cold Rolling Step (S6)]

The above described hot-rolled steel sheet is subjected to cold rolling to produce an intermediate product in the shape of the tailored rolled blank. For example, a single-stand cold rolling mill having a pair of rolling rolls is used for the cold rolling. Rolling is performed while changing the roll reduction at one or a plurality of locations in the longitudinal direction of the hot-rolled steel sheet so that the sheet thickness changes in a tapered shape. In this case, an intermediate product in which the sheet thickness changes in the rolling direction is produced.

A reduction (cold rolling rate) R in the cold rolling is in a range from more than 5% to 50%. That is, a cold rolling rate $R_{min}$ at a thickest wall portion is more than 5%, and a cold rolling rate $R_{max}$ at a thinnest wall portion is 50% or less. If the cold rolling rate R is 5% or less, the introduced amount of dislocations that serve as precipitation sites of fine Ti carbo-nitrides in a precipitation hardening heat treatment in the next step is small, and hence the precipitation amount of fine Ti carbo-nitrides will be small. In this case, the strength of the tailored rolled blank decreases. On the other hand, if the cold rolling rate R is more than 50%, an excessive amount of dislocations will be introduced during cold rolling. In this case, sufficient recovery will not occur in the precipitation hardening heat treatment, and a large number of dislocations will remain even after the precipitation hardening heat treatment. Consequently, the cold formability of the tailored rolled blank will decrease. Furthermore, if the cold rolling rate R is more than 50%, grains of the {110}<001> crystal orientation in the outer layer of the hot-rolled steel sheet will disappear. In this case, a hardness difference between a thick-wall portion and a thin-wall portion increases, and the cold formability decreases.

If the cold rolling rate R is in the range of more than 5% to 50%, even after cold rolling, grains of the {110}<001> crystal orientation of the outer layer remain. Therefore, a hardness difference between a thick-wall portion and a thin-wall portion can be suppressed, and the cold formability of the tailored rolled blank is secured. In addition, because the hardness ratio HR of the tailored rolled blank is within a range of more than 1.0 to 1.5, excellent cold formability is obtained.

[Precipitation Hardening Heat Treatment Step (S7)]

A precipitation hardening heat treatment is performed on the intermediate product produced by cold rolling, to thereby produce a tailored rolled blank.

The heat treatment equipment that is used for the precipitation hardening heat treatment is not particularly limited. The heat treatment equipment may be a continuous heat treatment apparatus or may be a batch-type heat treatment furnace. The various conditions in the precipitation hardening heat treatment are as follows.

Highest heating temperature $T_{max}$ during precipitation hardening heat treatment: 600 to 750° C.

The highest heating temperature $T_{max}$ during the precipitation hardening heat treatment is from 600 to 750° C. In this case, using the dislocations introduced by the cold rolling as precipitation sites, a large number of fine Ti carbo-nitrides precipitate. If the highest heating temperature $T_{max}$ is less than 600° C., the precipitation amount of fine Ti carbo-nitrides will be insufficient, and the tensile strength of the tailored rolled blank cannot be improved. On the other hand, if the highest heating temperature $T_{max}$ is more than 750° C., even if a holding time period $t_K$ ($t_K$>0) at 600° C. or more during the precipitation hardening heat treatment is an extremely short time period, precipitation of fine Ti carbo-nitrides is excessively promoted and results in over-ageing. In this case also, the tensile strength of the tailored rolled blank cannot be improved. Therefore, the highest heating temperature $T_{max}$ is in a range from 600 to 750° C.

Holding Time Period $t_K$: $530-0.7\times T_{max}$ to $3600-3.9\times T_{max}$

In the precipitation hardening heat treatment, a holding time period $t_K$ at 600° C. or more satisfies Formula (5) with respect to the highest heating temperature $T_{max}$.

$$530-0.7\times T_{max}\leq t_K\leq 3600-3.9\times T_{max} \quad (5)$$

If the holding time period $t_K$ is less than $530-0.7\times T_{max}$, precipitation of fine Ti carbo-nitrides will not progress sufficiently. On the other hand, if the holding time period $t_K$ is more than $3600-3.9\times T_{max}$, precipitation of Ti carbo-nitride will be excessively promoted and over-aging will occur.

Heat Treatment Index IN: 16500 to 19500

A heat treatment index IN is a value obtained using a heating temperature $T_n$(K) of the precipitation hardening heat treatment and a time period t (in hr units; hereunder referred to as 'heat treatment time period t") from the start of the heat treatment until the end thereof, by indexing the rearrangement and annihilation of dislocations, Ostwald growth and the like of carbo-nitrides, and phenomena that arise depending on the thermal activation process such as a slipping motion of dislocations, a cross-slip, upward movement of dislocations caused by diffusion of vacancies, and diffusion within the base compound of alloying elements that are elementary processes thereof (Non Patent Literature 3: Toshihiro Tsuchiyama, Heat Treatment 42 (2002), 163).

In general, this index is a value obtained when a tempering parameter that is applied as (T+273)(log(t/3600)+C) at a time that the intermediate product is held for a time period t (seconds) at a certain fixed temperature T (° C.) is extended to heat treatment conditions in which temperature fluctuations continuously arise. In the precipitation hardening heat treatment at the temperature that is finally arrived at, a heat treatment starting temperature is taken as $T_1$ (° C.), the heat treatment time period t is divided by a very small time period $\Delta t_{IN}$ (sec), and an average heating temperature in an $n^{th}$ interval $\Delta t_{IN}$ (=$t_n$) is taken as $T_n$ (where n is a natural number). Specifically, a very small time period t1 is determined that is a time period such that a value equal to $IN_1$ is obtained at an average heating temperature $T_2$ for very small time period regions $\Delta t_{IN}$ that are next in a consecutive manner after the heat treatment index IN (in this case, denoted by "$IN_1$") at $T_1$ is determined. Using the determined very small time period t1, IN is determined for a ($\Delta t_{IN}$+t1) time period at $T_2$, and the determined IN is taken as the heat treatment index IN for the period from the start of the heat treatment until t2. The heat treatment index IN can be determined up to the $n^{th}$ interval by repeating a similar calculation. At this time, the heat treatment index IN at a time point at which precipitation hardening heat treatment is completed up to the $n^{th}$ interval is defined by Formula (6). Note that, in the present invention, the very small time period $\Delta t_{IN}$ is taken as being 1 second.

$$IN=(T_n+273)(\log(t_n/3600)+20) \quad (6)$$

Where, $t_n$ in Formula (6) is defined by Formula (7).

$$t_n/3600=10^X+\Delta t_{IN}/3600 \quad (7)$$

Where, $X=((T_{n-1}+273)/(T_n+273))(\log(t_{n-1}/3600)+20)-20$. Further, $t1=\Delta t_{IN}$.

Tn in Formula (6) is defined by Formula (8).

$$T_n=T_{n-1}+\alpha\Delta t_{IN} \quad (8)$$

Where, $\alpha$ represents a rate of temperature increase or cooling rate (° C./s) at the temperature $T_{n-1}$.

If the heat treatment index IN is more than 19500, in some cases precipitation of fine Ti carbo-nitrides progresses too much and over-aging occurs. In addition, recovery of dislocations progresses too much and the tensile strength decreases. On the other hand, if the heat treatment index IN is less than 16500, precipitation of fine Ti carbo-nitrides does not adequately progress. In such a case also, the desired tensile strength is not obtained. In addition, because recovery of dislocations does not progress and ductility is not improved, the formability of the tailored rolled blank decreases.

By performing the above described production steps, a tailored rolled blank having the aforementioned characteristics is produced.

[Other Steps]

In the steps for producing the hot-rolled steel sheet, a galvanizing treatment step may also be performed, or a galvanizing treatment step may be performed after the aforementioned precipitation hardening heat treatment. The precipitation hardening heat treatment may also be performed during a galvanizing treatment step. A separate surface treatment may also be additionally performed on the hot-rolled steel sheet on which a galvanized layer is formed. In a case of performing a galvanizing treatment on the tailored rolled blank after pickling, an alloying treatment may be performed as required to form an alloyed galvanized layer. In this case, in the tailored rolled blank, excellent corrosion resistance is obtained and the welding resistance with respect to various kinds of welding such as spot welding is enhanced.

EXAMPLES

[Evaluation of Hot-Rolled Steel Sheet]

[Production Method]

Molten steel having the chemical compositions described in Table 1 were produce, and slabs were produced using the molten steel.

[Table 1]

TABLE 1

| Steel Type | Chemical Composition (unit: mass %; balance being Fe and impurities) | | | | | | | | | | | | | | | | | | | | | |
|---|---|---|---|---|---|---|---|---|---|---|---|---|---|---|---|---|---|---|---|---|---|---|
| | C | Si | Mn | P | S | Al | N | Ti | Nb | Cu | Ni | Mo | V | Cr | W | Mg | Ca | REM | B | Other | F1 | Remarks |
| A | 0.065 | 1.20 | 2.44 | 0.016 | 0.003 | 0.024 | 0.0026 | 0.144 | 0.020 | — | — | — | — | — | — | 0.001 | — | — | 0.001 | — | 0.1306 | Present Invention Example |
| B | 0.062 | 0.06 | 1.99 | 0.014 | 0.002 | 0.011 | 0.0039 | 0.076 | 0.039 | — | — | — | — | — | — | — | 0.002 | — | — | — | 0.0596 | Present Invention Example |
| C | 0.042 | 0.73 | 1.04 | 0.010 | 0.001 | 0.028 | 0.0038 | 0.034 | 0.019 | — | — | — | — | — | — | — | — | 0.001 | — | — | 0.0195 | Present Invention Example |
| D | 0.081 | 0.29 | 1.61 | 0.011 | 0.003 | 0.025 | 0.0040 | 0.138 | — | — | — | — | — | — | — | — | — | — | — | — | 0.1198 | Present Invention Example |
| E | 0.075 | 0.25 | 1.30 | 0.011 | 0.005 | 0.034 | 0.0019 | 0.125 | — | 0.08 | 0.04 | — | — | — | — | — | — | — | — | — | 0.1110 | Present Invention Example |
| F | 0.077 | 0.23 | 1.41 | 0.012 | 0.004 | 0.021 | 0.0033 | 0.133 | — | — | — | 0.12 | — | — | — | — | — | — | — | Zr: 0.02 | 0.1157 | Present Invention Example |
| G | 0.078 | 0.29 | 1.52 | 0.008 | 0.006 | 0.022 | 0.0040 | 0.135 | — | — | — | — | 0.11 | — | — | — | — | — | — | Sn: 0.01 | 0.1123 | Present Invention Example |
| H | 0.074 | 0.32 | 1.46 | 0.015 | 0.007 | 0.012 | 0.0046 | 0.144 | — | — | — | — | — | 0.10 | — | — | — | — | — | Co: 0.002 | 0.1177 | Present Invention Example |
| I | 0.073 | 0.33 | 1.57 | 0.010 | 0.004 | 0.025 | 0.0058 | 0.148 | — | — | — | — | — | — | 0.13 | — | — | — | — | Zn: 0.004 | 0.1221 | Present Invention Example |
| J | 0.120* | 0.64 | 1.11 | 0.010 | 0.002 | 0.034 | 0.0044 | 0.044 | 0.018 | — | — | — | — | — | — | — | — | — | — | — | 0.0259 | Comparative Example |
| K | 0.026* | 0.66 | 1.10 | 0.003 | 0.002 | 0.037 | 0.0045 | 0.037 | 0.014 | — | — | — | — | — | — | — | — | — | — | — | 0.0186 | Comparative Example |
| L | 0.045 | 0.71 | 1.08 | 0.011 | 0.001 | 0.034 | 0.0044 | 0.154* | 0.022 | — | — | — | — | — | — | — | — | — | — | — | 0.1374 | Comparative Example |
| M | 0.048 | 0.75 | 1.07 | 0.002 | 0.001 | 0.021 | 0.0028 | 0.014* | 0.020 | — | — | — | — | — | — | — | — | — | — | — | 0.0029 | Comparative Example |
| N | 0.050 | 0.73 | 1.08 | 0.002 | 0.001 | 0.035 | 0.0042 | 0.005* | 0.024 | — | — | — | — | — | — | — | — | — | — | — | −0.0109* | Comparative Example |
| O | 0.046 | 0.73 | 1.01 | 0.005 | 0.001 | 0.032 | 0.0108* | 0.040 | 0.022 | — | — | — | — | — | — | — | — | 0.0008 | — | — | 0.0015 | Comparative Example |
| P | 0.045 | 0.53 | 1.39 | 0.009 | 0.009 | 0.03 | 0.0072 | 0.035 | — | — | — | — | — | — | — | — | — | — | — | — | −0.0032 | Comparative Example |

*indicates value is outside range prescribed in present invention.

Hot-rolled steel sheets were produced using the slabs under the conditions shown in Table 2.

[Table 2]

TABLE 2

| Heat | Metallurgical Factors | | | Production Conditions: Heating (S1) | | Rough Rolling (S2) | | | Finish Rolling (S3) | | | | | | Cooling (S4) | | | | Coiling (S5) | |
|---|---|---|---|---|---|---|---|---|---|---|---|---|---|---|---|---|---|---|---|---|
| Rolling Number | Steel Type | $SRT_{min}$ (° C.) | $Ar_3$ (° C.) | $T_{S1}$ (° C.) | $t_{S1}$ (min) | Total Passes Number TPN | Overall reduction $R_{S2}$ (%) | Specific Passes Number SPN | Waiting Time $t_{S3}$ (sec) | Starting Temperature $T_{S3}$ (° C.) | Overall reduction $R_{S3}$ (%) | Final Two Passes reduction $R_{F2}$ (%) | FT (° C.) | Shape Ratio SR | Waiting Time $t_{S4}$ (sec) | Cooling Rate CR (° C./sec) | Stopping Temperature $T_{S4}$ (° C.) | Diffusion Length $L_{total}$ (μm) | CT (° C.) | Remarks |
| 1 | A | 1233 | 646 | 1250 | 90 | 9 | 86 | 3 | 60 | 1050 | 91 | 38 | 980 | 5.2 | 1.8 | 40 | 465 | 0.02 | 450 | Present Invention Example |
| 2 | B | 1173 | 718 | 1200 | 90 | 9 | 86 | 3 | 60 | 1030 | 91 | 38 | 970 | 4.7 | 1.5 | 30 | 565 | 0.08 | 550 | Present Invention Example |
| 3 | B | 1173 | 718 | 1100* | 90 | 9 | 86 | 3 | 60 | 1000 | 91 | 38 | 940 | 5 | 1.5 | 20 | 565 | 0.10 | 550 | Comparative Example |
| 4 | B | 1173 | 718 | 1200 | 90 | 9 | 86 | 3 | 60 | 1020 | 91 | 38 | 950 | 5.5 | 1.5 | 15 | 565 | 0.11 | 550 | Present Invention Example |
| 5 | B | 1173 | 718 | 1200 | 90 | 3 | 58* | 2 | 60 | 1000 | 91 | 38 | 940 | 5.2 | 1.5 | 20 | 565 | 0.10 | 550 | Comparative Example |
| 6 | B | 1173 | 718 | 1200 | 90 | 7 | 72 | 0* | 60 | 1000 | 91 | 38 | 940 | 4.8 | 1.5 | 20 | 565 | 0.10 | 550 | Comparative Example |
| 7 | B | 1173 | 718 | 1200 | 90 | 9 | 86 | 3 | 180* | 1000 | 91 | 38 | 940 | 4.6 | 1.5 | 20 | 565 | 0.10 | 550 | Comparative Example |
| 8 | B | 1173 | 718 | 1200 | 90 | 9 | 86 | 3 | 60 | 980* | 91 | 38 | 920 | 5.8 | 1.5 | 20 | 565 | 0.10 | 550 | Comparative Example |
| 9 | B | 1173 | 718 | 1200 | 90 | 9 | 86 | 3 | 60 | 1030 | 74* | 38 | 940 | 4.3 | 1.5 | 20 | 565 | 0.10 | 550 | Comparative Example |
| 10 | B | 1173 | 718 | 1200 | 90 | 9 | 86 | 3 | 60 | 1030 | 91 | 28* | 940 | 3.6 | 1.5 | 20 | 565 | 0.10 | 550 | Comparative Example |
| 11 | B | 1173 | 718 | 1200 | 90 | 9 | 86 | 3 | 60 | 1030 | 91 | 38 | 940 | 5.5 | 4.4* | 20 | 565 | 0.10 | 550 | Comparative Example |
| 12 | B | 1173 | 718 | 1200 | 90 | 9 | 86 | 3 | 60 | 1030 | 91 | 38 | 940 | 5.1 | 1.5 | 8* | 615* | 0.17* | 600 | Comparative Example |
| 13 | B | 1173 | 718 | 1200 | 90 | 9 | 86 | 3 | 60 | 1030 | 91 | 38 | 940 | 4.9 | 1.5 | 15 | 665* | 0.14 | 650* | Comparative Example |
| 14 | C | 1079 | 834 | 1150 | 120 | 11 | 90 | 1 | 30 | 1045 | 90 | 32 | 920 | 4.5 | 1.3 | 70 | 100 | 0.14 | ≤100 | Present Invention Example |
| 15 | C | 1079 | 834 | 1150 | 120 | 11 | 90 | 1 | 30 | 1045 | 90 | 32 | 820* | 4.3 | 1.3 | 70 | 100 | 0.14 | ≤100 | Comparative Example |
| 16 | C | 1079 | 834 | 1150 | 120 | 11 | 90 | 1 | 30 | 1045 | 90 | 32 | 1020* | 4.8 | 1.3 | 30 | 515 | 0.36* | 500 | Comparative |

TABLE 2-continued

| Heat | Metallurgical Factors | | | Production Conditions: Heating (S1) | | Rough Rolling (S2) | | | Finish Rolling (S3) | | | | | | Cooling (S4) | | | | Coiling (S5) | |
|---|---|---|---|---|---|---|---|---|---|---|---|---|---|---|---|---|---|---|---|---|
| | | | | | | Total Passes | Overall reduction | Specific Passes | Waiting Time | Starting Temperature | Overall reduction | Final Two Passes reduction | | Shape | Waiting Time | Cooling | Stopping Temperature | Diffusion Length | | |
| Rolling Number | Steel Type | $SRT_{min}$ (° C.) | $Ar_3$ (° C.) | $T_{S1}$ (° C.) | $t_{S1}$ (min) | Number TPN | $R_{S2}$ (%) | Number SPN | $t_{S3}$ (sec) | $T_{S3}$ (° C.) | $R_{S3}$ (%) | $R_{F2}$ (%) | FT (° C.) | Ratio SR | $t_{S4}$ (sec) | Rate CR (° C./sec) | $T_{S4}$ (° C.) | $L_{total}$ (μm) | CT (° C.) | Remarks |
| 17 | C | 1079 | 834 | 1150 | 120 | 11 | 90 | 1 | 30 | 1045 | 90 | 32 | 920 | 4.7 | 1.3 | 15 | 615* | 0.62* | 600 | Comparative Example |
| 18 | D | 1249 | 781 | 1250 | 60 | 5 | 81 | 3 | 120 | 1020 | 87 | 32 | 950 | 4.6 | 1.3 | 40 | 465 | 0.14 | 450 | Present Invention Example |
| 19 | E | 1233 | 799 | 1250 | 60 | 5 | 81 | 3 | 120 | 1020 | 87 | 32 | 950 | 4.3 | 1.3 | 50 | 365 | 0.14 | 350 | Present Invention Example |
| 20 | F | 1241 | 787 | 1250 | 60 | 7 | 86 | 2 | 90 | 1040 | 92 | 32 | 960 | 4.1 | 1.3 | 50 | 515 | 0.15 | 500 | Present Invention Example |
| 21 | G | 1244 | 789 | 1250 | 60 | 7 | 86 | 2 | 90 | 1040 | 92 | 32 | 960 | 4 | 1.3 | 50 | 465 | 0.14 | 450 | Present Invention Example |
| 22 | H | 1245 | 787 | 1250 | 60 | 3 | 77 | 3 | 45 | 1065 | 87 | 45 | 980 | 5.7 | 1.3 | 40 | 415 | 0.14 | 400 | Present Invention Example |
| 23 | I | 1246 | 787 | 1250 | 60 | 3 | 77 | 3 | 45 | 1065 | 87 | 45 | 980 | 6.2 | 1.3 | 40 | 415 | 0.14 | 400 | Present Invention Example |
| 24 | J* | 1182 | 803 | 1200 | 90 | 7 | 86 | 2 | 90 | 1030 | 92 | 45 | 920 | 6.5 | 1.3 | 60 | 415 | 0.14 | 400 | Comparative Example |
| 25 | K* | 1050 | 837 | 1200 | 90 | 7 | 86 | 2 | 90 | 1010 | 92 | 45 | 920 | 5.8 | 1.3 | 70 | 100 | 0.14 | ≤100 | Comparative Example |
| 26 | L* | 1206 | 828 | 1250 | 90 | 7 | 86 | 2 | 90 | 1010 | 92 | 45 | 920 | 5.6 | 1.3 | 50 | 100 | 0.15 | ≤100 | Comparative |

TABLE 2-continued

| Heat | Metallurgical Factors | | | Production Conditions: Heating (S1) | | Rough Rolling (S2) | | | Finish Rolling (S3) | | | | | | Cooling (S4) | | | | Coiling (S5) | |
|---|---|---|---|---|---|---|---|---|---|---|---|---|---|---|---|---|---|---|---|---|
| | | | | | | Total Passes | Overall reduction | Specific Passes | Waiting Time | Starting Temperature | Overall reduction | Final Two Passes reduction | | Shape | Waiting Time | Cooling | Stopping Temperature | Diffusion Length | | |
| Rolling Number | Steel Type | $SRT_{min}$ (° C.) | $Ar_3$ (° C.) | $T_{S1}$ (° C.) | $t_{S1}$ (min) | Number TPN | $R_{S2}$ (%) | Number SPN | $t_{S3}$ (sec) | $T_{S3}$ (° C.) | $R_{S3}$ (%) | $R_{F2}$ (%) | FT (° C.) | Ratio SR | $t_{S4}$ (sec) | Rate CR (° C./sec) | $T_{S4}$ (° C.) | $L_{total}$ (μm) | CT (° C.) | Remarks |
| 27 | M* | 1025 | 829 | 1200 | 90 | 7 | 86 | 2 | 90 | 1010 | 92 | 45 | 920 | 6.1 | 1.3 | 100 | 415 | 0.16 | 400 | Example |
| 28 | N* | 962 | 825 | 1200 | 90 | 7 | 86 | 2 | 90 | 1010 | 92 | 45 | 920 | 6 | 1.3 | 100 | 415 | 0.15 | 400 | Comparative Example |
| 29 | O* | 1098 | 833 | 1200 | 90 | 7 | 86 | 2 | 90 | 1010 | 92 | 45 | 920 | 5.8 | 1.3 | 100 | 415 | 0.17* | 400 | Comparative Example |
| 30 | B | 1173 | 718 | 1200 | 90 | 9 | 86 | 3 | 60 | 1010 | 87 | 32 | 930 | 2.9* | 1.5 | 20 | 565 | 0.10 | 550 | Comparative Example |
| 31 | P* | 1086 | 815 | 1200 | 90 | 9 | 89 | 1 | 30 | 1045 | 90 | 37 | 900 | 4.5 | 1.3 | 70 | 100 | 0.14 | ≤100 | Comparative Example |

*indicates value is outside range prescribed in present invention.

Referring to Table 2, first, a solution treatment was performed at a solution temperature $SRT_{min}$ (° C.) described in Table 2 with respect to the respective slabs of the steel types described in the "steel type" column. Thereafter, the relevant slab was heated for a period corresponding to $t_{S1}$ at a heating temperature $T_{S1}$° C. in the heating step (S1). The rough rolling step (S2) was performed on the relevant heated slab to produce a rough bar. The total passes number TPN (times), the overall reduction $R_{S2}$(%), and the specific passes number SPN (times) at this time were as shown in Table 2.

The finish rolling step (S3) was performed using the thus-produced rough bar. The time period $t_{S3}$ (sec) from after the end of rough rolling to the start of finish rolling, the finish rolling starting temperature $T_{S3}$ (° C.), the overall reduction $R_{S3}$(%), the final two passes reduction $R_{F2}$(%), the finish rolling ending temperature FT (° C.) and the shape ratio SR at this time were as shown in Table 2, respectively.

The cooling step (S4) was performed on the hot-rolled steel sheet after the completion of finish rolling. In the cooling step, the time period $t_{S4}$ (sec) from after the end of the finish rolling until cooling started, the average cooling rate CR (° C./sec), the cooling stopping temperature $T_{S4}$ (° C.) and the total cumulative diffusion length $L_{total}$(μm) were as shown in Table 2, respectively.

A coiling step (S5) was performed on the hot-rolled steel sheet after the cooling step. The coiling temperature CT was as shown in Table 2.

[Evaluation Test]

The following tests were performed on the respective hot-rolled steel sheets obtained by the above described production steps.

[Microstructure Observation Test]

A sample was extracted from the hot-rolled steel sheets of the respective hot rolling numbers, and microstructure observation was performed by the above described method. Further, by the above described method, phases within the microstructure of each hot rolling number were identified, and the area ratio (%) of each phase was determined. Table 3 shows the area ratio of each phase. In a "bainite" column in Table 3, the area ratio (%) of bainite is described. In an "other" column, "PF" indicates the area ratio of polygonal ferrite, "M" indicates the area ratio of martensite, "P" indicates the area ratio of pearlite, and "worked F" indicates the area ratio of worked ferrite. In the present examples, when the circumferential length of a target ferrite grain is represented by lq, and the circle-equivalent diameter thereof is represented by dq, ferrite for which lq/dq≥3.5 is defined as worked ferrite.

[Fine Ti Carbo-Nitrides Number Density $n_0$ and BH Amount Measurement Test]

Samples were taken from a center portion in the sheet thickness direction of each hot rolling number, and the number density $n_0$ of fine Ti carbo-nitrides as well as the BH amount were determined by the above described method. The determined number densities $n_0$ and BH amounts are shown in Table 3.

[Pole Densities D1 to D3 Measurement Test]

The pole density D1 of the orientation group {100}<011> to {223}<110>, the pole density D2 of the {332}<113> crystal orientation, and the pole density D3 of the {110}<001> crystal orientation were determined by the above described method. The obtained pole densities D1 to D3 are shown in Table 3.

[Tension Test]

A No. 5 test coupon was extracted from each hot rolling number in conformity with JIS Z 2201. A tension test was performed in conformity with JIS Z 2241 at ordinary temperature using the extracted No. 5 test coupons. The yield strength YP (MPa), tensile strength TS (MPa) and breaking elongation El (%) were determined. The determined yield strength YP (MPa), tensile strength TS (MPa) and breaking elongation El (%) are shown in Table 3.

In addition, |Δr| that is an index of in-plane anisotropy was determined by the following method. A test specimen was taken from a portion at a position equivalent to ¼ of the sheet width of the hot-rolled steel sheet. A plastic strain ratio ($r_0$) in the rolling direction, a plastic strain ratio ($r_{45}$) in a 45° direction relative to the rolling direction, and a plastic strain ratio ($r_{90}$) in a 90° direction (sheet-width direction) relative to the rolling direction were determined using the test specimen. |Δr| was determined by the following formula using the determined values.

$$|\Delta r| = |(r_0 - 2 \times r_{45} + r_{90})/2|$$

The respective targets for the tensile strength of the hot-rolled steel sheets are as follows:

Steel type A of 980 MPa-class: more than 915 MPa;

Steel types B, D and J of 780 MPa-class: more than 715 MPa;

Steel types C, E, F, H, I and L of 690 MPa-class: more than 625 MPa; and

Steel types G, K, M, N, O and P of 590 MPa-class: more than 525 MPa.

It was determined that if the breaking elongation El of the hot-rolled steel sheet is 13% or more, it is difficult for press cracking to occur in the tailored rolled blank after precipitation hardening heat treatment, and excellent cold formability is exhibited in the hot-rolled steel sheet and the tailored rolled blank.

It was determined that if |Δr| that is the index of in-plane anisotropy is 0.6 or less, the in-plane anisotropy is small, and excellent cold formability is exhibited in the hot-rolled steel sheet. In contrast, it was determined that if |Δr| is more than 0.6, the in-plane anisotropy is large and trimming is required, and hence the yield is lowered.

[Test Results]

The test results are shown in Table 3.

[Table 3]

TABLE 3

| Heat Rolling Number | Steel Type | Microstructure: Area Ratio (%) Bainite | Other | Ti State: Ti Presence State | Number Density $n_0$ ($\times 10^{17}$ per $cm^3$) | BH Amount (MPa) | Pole Density D1 | Pole Density D2 | Pole Density D3 | Mechanical Characteristics: YP (MPa) | TS (MPa) | El (%) | \|Δr\| | Remarks |
|---|---|---|---|---|---|---|---|---|---|---|---|---|---|---|
| 1 | A | 85 | PF: 13, M: 2 | Dissolved/Cluster | 0.02 | 47 | 1.7 | 2.5 | 4.2 | 932 | 1063 | 13.3 | 0.27 | Present Invention Example |
| 2 | B | 55 | PF: 45 | Dissolved/Cluster | 0.01 | 52 | 1.8 | 2.6 | 3.7 | 686 | 726 | 17.0 | 0.30 | Present Invention Example |
| 3 | B | 45 | PF: 55 | Coarse Precipitate | 0.01 | 7* | 2.1 | 3.1 | 3.8 | 612 | 658 | 23.4 | 0.45 | Comparative Example |
| 4 | B | 50 | PF: 50 | Dissolved/Cluster | 0.01 | 65 | 2.0 | 2.9 | 4.9 | 674 | 715 | 17.2 | 0.40 | Present Invention Example |
| 5 | B | 45 | PF: 55 | Coarse Precipitate | 0.3 | 9* | 2.1 | 3.1 | 4.1 | 697 | 710 | 12.3 | 0.45 | Comparative Example |
| 6 | B | 45 | PF: 55 | Coarse Precipitate | 0.5 | 8* | 2.1 | 3.1 | 4.6 | 680 | 715 | 11.7 | 0.45 | Comparative Example |
| 7 | B | 45 | PF: 55 | Coarse Precipitate | 0.2 | 9* | 2.1 | 3.1 | 4.1 | 684 | 705 | 16.2 | 0.45 | Comparative Example |
| 8 | B | 40 | PF: 60 | Coarse Precipitate | 0.1 | 14* | 2.5 | 3.5 | 4.4 | 678 | 722 | 16.1 | 0.57 | Comparative Example |
| 9 | B | 45 | PF: 55 | Coarse Precipitate | 0.1 | 2* | 2.1 | 3.1 | 3.5 | 669 | 725 | 10.3 | 0.45 | Comparative Example |
| 10 | B | 45 | PF: 55 | Dissolved/Cluster | 0.01 | 57 | 4.2* | 4.6 | 2.8 | 688 | 733 | 16.3 | 0.88* | Comparative Example |
| 11 | B | 40 | PF: 60 | Coarse Precipitate | 0.2 | 10* | 2.1 | 3.1 | 5.1 | 623 | 690 | 16.2 | 0.45 | Comparative Example |
| 12 | B | 40 | PF: 60 | TiC Precipitate | 2 | 5* | 2.1 | 3.1 | 4.0 | 630 | 702 | 15.8 | 0.45 | Comparative Example |
| 13 | B | 0* | PF: 75, P: 25 | TiC Precipitate | 1.8 | 2* | 2.1 | 3.1 | 4.0 | 703 | 776 | 14.6 | 0.45 | Comparative Example |
| 14 | C | 20 | PF: 78, M: 2 | Dissolved/Cluster | 0.3 | 43 | 2.5 | 3.5 | 3.7 | 561 | 663 | 30.4 | 0.57 | Present Invention Example |
| 15 | C | 15* | Worked F: 13, M: 2 | Coarse Precipitate | 0.07 | 14* | 5.4** | 5.7** | 4.2 | 716 | 723 | 9.6 | 1.21 | Comparative Example |
| 16 | C | 45 | PF: 55 | TiC Precipitate | 2* | 3* | 1.6 | 2.3 | 2.1* | 624 | 710 | 16.0 | 0.22 | Comparative Example |
| 17 | C | 0* | PF: 95, P: 5 | TiC Precipitate | 1.1* | 7* | 2.5 | 3.5 | 3.6 | 633 | 708 | 15.4 | 0.57 | Comparative Example |
| 18 | D | 50 | PF: 50 | Dissolved/Cluster | 0.01 | 38 | 2.0 | 2.9 | 3.7 | 748 | 866 | 15.8 | 0.40 | Present Invention Example |
| 19 | E | 35 | PF: 65 | Dissolved/Cluster | 0.02 | 52 | 2.0 | 2.9 | 3.2 | 561 | 650 | 29.7 | 0.40 | Present Invention Example |
| 20 | F | 25 | PF: 75 | Dissolved/Cluster | 0.01 | 65 | 1.9 | 2.7 | 3.0 | 580 | 661 | 29.6 | 0.35 | Present Invention Example |
| 21 | G | 30 | PF: 70 | Dissolved/Cluster | 0.01 | 43 | 1.9 | 2.7 | 3.0 | 556 | 624 | 31.0 | 0.35 | Present Invention Example |
| 22 | H | 35 | PF: 65 | Dissolved/Cluster | 0.02 | 49 | 1.7 | 2.5 | 5.0 | 564 | 638 | 30.0 | 0.27 | Present Invention Example |
| 23 | I | 35 | PF: 65 | Dissolved/Cluster | 0.03 | 52 | 1.7 | 2.5 | 5.6 | 603 | 664 | 28.8 | 0.27 | Present Invention Example |
| 24 | J* | 0* | PF: 80, P: 20* | Dissolved/Cluster | 0.01 | 27 | 2.5 | 3.5 | 4.9 | 798 | 886 | 11.0 | 0.57 | Comparative Example |
| 25 | K* | 0* | PF: 100* | Dissolved/Cluster | 0.01 | 32 | 2.5 | 3.5 | 4.7 | 287 | 451 | 38.4 | 0.57 | Comparative Example |
| 26 | L* | 20 | PF: 15, M: 5 | Dissolved/Cluster | 0.01 | 41 | 4.8** | 5.4** | 4.7 | 622 | 677 | 24.0 | 1.11 | Comparative Example |
| 27 | M* | 25 | PF: 75 | Coarse Precipitate | 0.01 | 13* | 2.5 | 3.5 | 5.4 | 496 | 511 | 31.0 | 0.57 | Comparative Example |

TABLE 3-continued

| Heat Rolling Number | Steel Type | Microstructure: Area Ratio (%) Bainite | Other | Ti State: Ti Presence State | Number Density $n_0$ ($\times 10^{17}$ per $cm^3$) | BH Amount (MPa) | Pole Density D1 | Pole Density D2 | Pole Density D3 | Mechanical Characteristics: YP (MPa) | TS (MPa) | El (%) | \|Δr\| | Remarks |
|---|---|---|---|---|---|---|---|---|---|---|---|---|---|---|
| 28 | N* | 25 | PF: 75 | — | 0 | 43 | 2.5 | 3.5 | 5.5 | 448 | 488 | 32.0 | 0.57 | Comparative Example |
| 29 | O* | 25 | PF: 75 | TiC Precipitate | 2.3* | 11* | 2.5 | 3.5 | 5.0 | 477 | 519 | 30.4 | 0.57 | Comparative Example |
| 30 | B | 40 | PF: 60 | Dissolved | 0.01 | 38 | 2.7 | 3.5 | 1.8* | 689 | 731 | 16 | 0.29 | Comparative Example |
| 31 | P* | 25 | PF: 73, M2 | Dissolved | 0.01 | 29 | 2.6 | 3.4 | 3.7 | 497 | 556 | 28 | 0.53 | Comparative Example |

* and ** indicate value is outside range prescribed in present invention.

The chemical compositions of heat rolling numbers 1, 2, 4, 14, and 18 to 23 were appropriate, and the production conditions were also appropriate. Therefore, in the microstructure, the area ratio of bainite was 20% or more, and the balance was mainly ferrite. Further, each of the pole densities D1 to D3 were also appropriate. In addition, the number density $n_0$ of the Ti carbo-nitrides was $1\times10^{17}$ per $cm^3$ or less. Consequently, a high tensile strength was obtained. Furthermore, the breaking elongation was 13% or more which serves as an index that indicates that the hot-rolled steel sheet has excellent cold formability. In addition, |Δr| was 0.6 or less, indicating that the in-plane anisotropy was sufficiently low.

On the other hand, although the chemical composition of heat rolling number 3 was appropriate, the heating temperature $T_{S1}$ was less than $SRT_{min}$. Consequently, although the number density $n_0$ of fine Ti carbo-nitrides was low, a large amount of coarse Ti carbo-nitrides remained, and the BH amount became low. As a result, the tensile strength of the hot-rolled steel sheet was a low strength of 715 MPa or less.

With regard to hot rolling number 5, the overall reduction $R_{S2}$ in the rough rolling step was too low. Consequently, inhomogeneousness of austenite particle diameters and segregation were not sufficiently resolved, and a large amount of coarse Ti carbo-nitrides that are ineffective for strengthening precipitated. Although the number density $n_0$ of fine Ti carbo-nitrides was low, the BH amount became low. As a result, the tensile strength of the hot-rolled steel sheet was a low strength of 715 MPa or less, and furthermore the breaking elongation was a low value of less than 13% and the cold formability of the hot-rolled steel sheet was low.

With regard to hot rolling number 6, in the rough rolling step, the specific passes number SPN for which rolling at a reduction of 20% or more was performed in a temperature range of 1050 to 1150° C. was less than 1, that is, 0. Consequently, inhomogeneousness of austenite particle diameters and segregation were not sufficiently resolved, and a large amount of coarse Ti carbo-nitrides that are ineffective for strengthening precipitated and the BH amount was low. As a result, the tensile strength of the hot-rolled steel sheet was a low strength of 715 MPa or less, and the breaking elongation was also a low value of less than 13%.

With regard to hot rolling number 7, the time period $t_{S3}$ until the start of finish rolling was too long. Consequently, the Ti carbo-nitrides coarsened and the BH amount became low. As a result, the tensile strength was a low strength of 715 MPa or less.

With regard to hot rolling number 8, the starting temperature $T_{S3}$ of the finish rolling temperature was too low. Consequently the BH amount became low. As a result, although there was no particular problem with respect to the characteristics (tensile strength TS, breaking elongation EL, and |Δr|) of the hot-rolled steel sheet, as described later, the cold formability of a tailored rolled blank produced using the hot-rolled steel sheet of hot rolling number 8 was low.

With regard to hot rolling number 9, the overall reduction $R_{S3}$ in finish rolling was too low. Consequently, austenite grains were not refined and inhomogeneous precipitation was promoted. As a result, the BH amount became low. In addition, bainite was formed in a row shape. Therefore, the breaking elongation was less than 13% and the cold formability of the hot-rolled steel sheet was low.

With regard to hot rolling number 10, the reduction $R_{F2}$ of the final two passes was less than 30%. Consequently, recrystallization at a center portion in the sheet thickness direction was insufficient after the final rolling reduction, and as a result the pole density D1 was less than 4. Therefore, |Δr| was more than 0.6.

With regard to hot rolling number 11, after the finish rolling, the time period $t_{S4}$ until the start of cooling was too long. Consequently, coarse Ti carbo-nitrides increased too much and the BH amount became low. As a result, the tensile strength was a low strength of 715 MPa or less.

With regard to hot rolling number 12, the average cooling rate CR in the cooling step was too slow. In addition, the cooling stopping temperature $T_{S4}$ was high, and the cumulative diffusion length $L_{total}$ was too large. Consequently, the number density $n_0$ of fine Ti carbo-nitrides was too high. As a result, the tensile strength was a low strength of 715 MPa or less.

With regard to hot rolling number 13, the cooling stopping temperature $T_{S4}$ and the coiling temperature CT were each too high. Consequently, bainite was not generated, and the number density $n_0$ of fine Ti carbo-nitrides was too high. As a result, although there was no particular problem with respect to the characteristics (tensile strength TS, breaking elongation EL, and |Δr|) of the hot-rolled steel sheet, as described later, the cold formability of a tailored rolled blank produced using the hot-rolled steel sheet of hot rolling number 13 was low.

With regard to hot rolling number 15, the finish rolling ending temperature FT in the finish rolling step was less than the $Ar_3$ point. Consequently, the area ratio of bainite in the microstructure was too low, and the area ratio of polygonal ferrite was also low. Further, a large amount of coarse Ti carbo-nitrides precipitated and the BH amount became less than 15 MPa. The pole densities D1 and D2 were also too high. As a result, |Δr| was more than 0.6 and the in-plane anisotropy was large. In addition, the breaking elongation EL was less than 13%, and the cold formability of the hot-rolled steel sheet was low.

With regard to hot rolling number 16, the ending temperature FT of the finish rolling was too high. Further, the cumulative diffusion length $L_{total}$ was too large. Consequently, the number density $n_0$ of fine Ti carbo-nitrides was too high. As a result, although there was no particular problem with respect to the characteristics (tensile strength TS, breaking elongation EL, and |Δr|) of the hot-rolled steel sheet, as described later, the cold formability of a tailored rolled blank produced using the hot-rolled steel sheet of hot rolling number 16 was low.

With regard to hot rolling number 17, the cooling stopping temperature $T_{S4}$ was too high and the cumulative diffusion length $L_{total}$ was too large. Consequently, bainite was not generated, and the number density $n_0$ of Ti carbo-nitrides was too high. As a result, although there was no particular problem with respect to the characteristics (tensile strength TS, breaking elongation EL, and |Δr|) of the hot-rolled steel sheet, as described later, the cold formability of a tailored rolled blank produced using the hot-rolled steel sheet of hot rolling number 17 was low.

In the case of hot rolling number 24, the C content was too high. Consequently, bainite was not generated, and the area ratio of ferrite was also low. As a result, the breaking elongation El was too low.

In the case of hot rolling number 25, the C content was too low. Consequently, bainite and ferrite were not generated, and the tensile strength was too low.

In the case of hot rolling number 26, the Ti content was too high. Consequently, the pole densities D1 and D2 were too high, and |Δr| was more than 0.6.

In the case of hot rolling number 27, the Ti content was too low. In addition, the cumulative diffusion length $L_{total}$ was too large. Consequently, coarse Ti carbo-nitrides formed and the BH amount decreased. As a result, the tensile strength of the hot-rolled steel sheet was low.

In the case of hot rolling number 28, the Ti content was too low. In addition, the value of F1 was less than 0 and did not satisfy Formula (1). As a result, the tensile strength was too low.

In the case of hot rolling number 29, the N content was too high. Consequently, the number density $n_0$ of fine Ti carbo-nitrides was too high and the tensile strength was low.

With regard to hot rolling number 30, the chemical composition was appropriate and F1 satisfied Formula (1). However, the shape ratio SR was too low. Consequently, the pole density D3 was too low. As a result, as described later, the hardness ratio HR of the tailored rolled blank was more than 1.5 and the cold formability of the tailored rolled blank was low.

With regard to hot rolling number 31, although the chemical composition was appropriate, F1 did not satisfy Formula (1). As a result, the tensile strength was too low.

[Production of Tailored Rolled Blanks]

Next, tailored rolled blanks were produced under the conditions shown in Table 4 using the hot-rolled steel sheets of each hot rolling number shown in Table 3.

[Table 4]

TABLE 4

| Cold Rolling Number | Heat Rolling Number | Strength Class | Cold Rolling (S6) Cold Rolling Rate (%) Rmin | Rmax | Trimsing | Precipitation Hardening Heat Treatment (S7) Heating System | Temperature Tmax (° C.) | F2 | Holding Time Period $t_4$ (sec) | F3 | Heat Treatment Index IN | Characteristics Dislocation Density p ($\times 10^{14}$ m$^2$) | Number Density R1 ($\times 10^{17}$ per cm$^3$) | Hardness Ratio HR | TS | Plating | Press Working Cracking | Strength | Remarks |
|---|---|---|---|---|---|---|---|---|---|---|---|---|---|---|---|---|---|---|---|
| 1-1 | 1 | 980 | 6 | 40 | No | BAF | 600 | 110 | 120 | 1260 | 17700 | 0.1 | 8 | 1.11 | 1139 | No | No | ○ | Present Invention Example |
| 2-1 | 2 | 780 | 6 | 35 | No | BAF | 600 | 110 | 120 | 1260 | 17700 | 0.01 | 5 | 1.12 | 806 | Yes | No | ○ | Present Invention Example |
| 2-2 | 2 | 780 | 0* | 30 | No | BAF | 600 | 110 | 120 | 1260 | 17700 | 0.000002 | 1* | 1.52* | 732 | Yes | Yes | — | Comparative Example |
| 2-3 | 2 | 780 | 10 | 60* | No | BAF | 600 | 110 | 120 | 1260 | 17700 | 10* | 5 | 1.18 | 812 | No | Yes | — | Comparative Example |
| 2-4 | 2 | 780 | 6 | 35 | No | BAF | 570* | 131 | 150 | 1377 | 16950 | 100* | 0.5* | 1.31 | 755 | No | Yes | — | Comparative Example |
| 2-5 | 2 | 780 | 6 | 35 | No | BAF | 850* | −65 | 120 | 285 | 23000* | 0.05 | 1* | 1.05 | 703 | Yes | No | X | Comparative Example |
| 2-6 | 2 | 780 | 6 | 35 | No | BAF | 600 | 110 | 1500* | 1260 | 17800 | 0.05 | 0.2* | 1.02 | 720 | Yes | No | X | Comparative Example |
| 2-7 | 2 | 780 | 6 | 45 | No | BAF | 750 | 5 | 650 | 675 | 19750* | 0.07 | 0.1* | 1.04 | 716 | No | No | X | Comparative Example |
| 2-8 | 2 | 780 | 6 | 35 | No | CAL | 700 | 40 | 90 | 870 | 18100 | 0.02 | 5 | 1.12 | 806 | No | No | ○ | Present Invention Example |
| 2-9 | 2 | 780 | 6 | 50 | No | CAL | 580* | 124 | 150 | 1338 | 16000* | 0.9 | 0.3* | 1.54* | 723 | No | Yes | — | Comparative Example |
| 2-10 | 2 | 780 | 6 | 50 | No | CAL | 800* | −30 | 90 | 480 | 19000 | 0.06 | 0.8* | 1.05 | 752 | No | No | X | Comparative Example |
| 2-11 | 2 | 780 | 6 | 50 | No | CAL | 700 | 40 | 10* | 870 | 18000 | 10* | 0.1* | 1.61* | 718 | Yes | Yes | — | Comparative Example |
| 2-12 | 2 | 780 | 6 | 50 | No | CAL | 600 | 110 | 120 | 1260 | 16350* | 10* | 0.08* | 1.51* | 806 | Yes | Yes | — | Comparative Example |
| 3-1 | 3 | 780 | 6 | 50 | No | BAF | 610 | 103 | 120 | 1221 | 18000 | 0.02 | 0.0000002* | 1.16 | 632 | No | No | X | Comparative Example |
| 4-1 | 4 | 780 | 10 | 50 | No | BAF | 650 | 75 | 90 | 1065 | 18500 | 0.01 | 3 | 1.13 | 800 | No | No | ○ | Present Invention Example |
| 5-1 | 5 | 780 | | | | | | | | Ruptured During Cold Rolling | | | | | | | | | Comparative Example |
| 6-1 | 6 | 780 | | | | | | | | Ruptured During Cold Rolling | | | | | | | | | Comparative Example |
| 7-1 | 7 | 780 | 8 | 40 | No | CAL | 700 | 40 | 60 | 870 | 18150 | 0.00002 | 0.2* | 0.89* | 687 | Yes | Yes | — | Comparative Example |
| 8-1 | 8 | 780 | 8 | 40 | No | CAL | 710 | 33 | 60 | 831 | 18350 | 0.00004 | 0.1* | 0.92* | 710 | Yes | Yes | — | Comparative Example |
| 9-1 | 9 | 780 | | | | | | | | Ruptured During Cold Rolling | | | | | | | | | Comparative Example |
| 10-1 | 10 | 780 | 8 | 40 | Yes | BAF | 620 | 96 | 150 | 1182 | 18000 | 0.03 | 5 | 1.57* | 807 | No | No | — | Comparative Example |
| 11-1 | 11 | 780 | 8 | 40 | No | BAF | 610 | 103 | 120 | 1221 | 17950 | 0.00002 | 0.2* | 0.98* | 701 | No | Yes | — | Comparative Example |
| 12-1 | 12 | 780 | 8 | 40 | No | BAF | 610 | 103 | 120 | 1221 | 17950 | 0.00004 | 0.1* | 0.87* | 713 | No | Yes | — | Comparative Example |
| 13-1 | 13 | 780 | 8 | 40 | No | BAF | 600 | 110 | 120 | 1260 | 17700 | 0.00005 | 0.5* | 0.96* | 752 | No | Yes | — | Comparative Example |

TABLE 4-continued

| Cold Rolling Number | Heat Rolling Number | Strength Class | Cold Rolling (S6) Cold Rolling Rate (%) Rmin | Rmax | Trimsing | Precipitation Hardening Heat Treatment (S7) Heating System | Temperature Tmax (° C.) | F2 | Holding Time Period $t_4$ (sec) | F3 | Heat Treatment Index IN | Characteristics Dislocation Density p ($\times 10^{14}$ $m^2$) | Number Density R1 ($\times 10^{17}$ per $cm^3$) | Hardness Ratio HR | TS | Plating | Press Working Cracking | Strength | Remarks |
|---|---|---|---|---|---|---|---|---|---|---|---|---|---|---|---|---|---|---|---|
| 14-1 | 14 | 690 | 6 | 40 | No | CAL | 740 | 12 | 30 | 714 | 19200 | 0.01 | 3 | 1.15 | 750 | No | No | ○ | Present Invention Example |
| 15-1 | 15 | 690 | | | | | | | | Ruptured During Cold Rolling | | | | | | | | | Comparative Example |
| 16-1 | 16 | 690 | 7 | 45 | No | CAL | 720 | 26 | 60 | 792 | 18450 | 0.0005 | 0.5* | 0.84* | 689 | Yes | Yes | — | Comparative Example |
| 17-1 | 17 | 690 | 7 | 45 | No | CAL | 720 | 26 | 60 | 792 | 18450 | 0.0002 | 0.5* | 0.88* | 692 | Yes | Yes | — | Comparative Example |
| 18-1 | 18 | 780 | 7 | 45 | No | BAF | 600 | 110 | 120 | 1260 | 17500 | 0.03 | 4 | 1.14 | 932 | No | No | ○ | Present Invention Example |
| 18-2 | 18 | 780 | 7 | 45 | No | CAL | 720 | 26 | 45 | 792 | 18500 | 0.02 | 6 | 1.14 | 940 | No | No | ○ | Present Invention Example |
| 18-3 | 18 | 780 | 7 | 45 | No | CAL | 850 | −65 | 240 | 285 | 22500 | 0.07 | 0.8* | 1.53* | 792 | No | Yes | — | Comparative Example |
| 19-1 | 10 | 590 | 6 | 35 | No | CAL | 710 | 33 | 150 | 831 | 18300 | 0.001 | 3 | 1.16 | 702 | No | No | ○ | Present Invention Example |
| 20-1 | 20 | 590 | 6 | 40 | No | CAL | 730 | 19 | 120 | 753 | 18750 | 0.006 | 4 | 1.18 | 729 | No | No | ○ | Present Invention Example |
| 21-1 | 21 | 590 | 6 | 35 | No | BAF | 610 | 103 | 120 | 1221 | 17950 | 0.002 | 2 | 1.16 | 692 | Yes | No | ○ | Present Invention Example |
| 22-1 | 22 | 590 | 6 | 40 | No | BAF | 660 | 68 | 90 | 1026 | 18650 | 0.004 | 5 | 1.18 | 749 | Yes | No | ○ | Present Invention Example |
| 23-1 | 23 | 590 | 6 | 35 | No | BAF | 640 | 82 | 90 | 1104 | 18300 | 0.001 | 3 | 1.16 | 699 | No | No | ○ | Present Invention Example |
| 24-1 | 24 | 780 | | | | | | | | Ruptured During Cold Rolling | | | | | | | | | Comparative Example |
| 25-1 | 25 | 440 | 6 | 50 | No | CAL | 700 | 40 | 90 | 870 | 18100 | 0.000002 | 0.1* | 0.87* | 435 | No | Yes | — | Comparative Example |
| 26-1 | 26 | 590 | 6 | 50 | Yes | CAL | 700 | 40 | 90 | 870 | 18100 | 2* | 5 | 1.57* | 723 | No | Yes | — | Comparative Example |
| 27-1 | 27 | 590 | 6 | 50 | No | CAL | 700 | 40 | 90 | 870 | 18100 | 0.01 | 0.000000001* | 1.68* | 500 | Yes | Yes | — | Comparative Example |
| 28-1 | 28 | 590 | 6 | 50 | No | CAL | 700 | 40 | 90 | 870 | 18100 | 0.01 | 0.000000003* | 1.61* | 488 | Yes | Yes | — | Comparative Example |
| 29-1 | 29 | 590 | | | | | | | | Ruptured During Cold Rolling | | | | | | | | | Comparative Example |
| 30-1 | 30 | 780 | 6 | 50 | No | CAL | 700 | 40 | 90 | 870 | 18100 | 0.02 | 4 | 1.52* | 802 | No | Yes | — | Comparative Example |
| 31-1 | 31 | 590 | 6 | 50 | No | CAL | 700 | 40 | 90 | 870 | 18100 | 0.01 | 0.0001* | 1.58* | 543 | No | Yes | — | Comparative Example |

*indicates value is outside range prescribed in present invention.

Specifically, using hot-rolled steel sheets of the hot rolling numbers shown in Table 4, first, cold rolling was performed to produce intermediate products in the shape of a tailored rolled blank. A minimum value $R_{min}$ and a maximum value $R_{max}$ of the cold rolling rate are shown in Table 4.

The respective intermediate products after cold rolling were subjected to precipitation hardening heat treatment under the conditions shown in Table 4 to produce tailored rolled blanks. In the "heating system" column in Table 4, the term "CAL" indicates that heat treatment equipment of a continuous type was used. The term "BAF" indicates that a heat treatment furnace of a batch type was used. In Table 4, "F2" indicates that $F2=530-0.7\times T_{max}$, and "F3" indicates that $F3=3600-3.9\times T_{max}$.

In Table 4, a "strength class" column indicates the strength class of the respective steel sheets after precipitation hardening heat treatment as one class among classes 440, 590, 780 and 980. In a case where the tensile strength after heat treatment is 800 MPa, the tensile strength is classified as the 780 MPa-class.

In addition, tailored rolled blanks of cold rolling numbers for which "Yes" is described in a "plating" column in Table 4 were subjected to molten galvanizing treatment and a plating layer was formed thereon.

[Evaluation Test]

[Dislocation Density ρ]

The dislocation density ρ was determined by the above described method. The determined dislocation densities ρ are shown in Table 4.

[Number Density $n_1$ of Fine Ti Carbo-Nitrides]

The number density $n_1$ of fine Ti carbo-nitrides was determined by the above described method. The determined number densities $n_1$ are shown in Table 4.

[Hardness Ratio HR]

The hardness ratio HR was determined based on the above described method. The determined hardness ratios HR are shown in Table 4.

[Formability Evaluation Test]

A press working test was performed on the tailored rolled blanks. In the press working test, a hat model die (R5, forming height 50 mm, base 80 mm) that simulated a B-pillar reinforcement was subjected to a press test at BHF 120 kN.

The result "Yes" was determined with respect to "press cracking" in a case where cracking occurred at a ridge line, and "No" was determined in a case where cracking did not occur. The presence/absence of cracking was determined by visual observation.

With regard to "member strength", a crushing test specimen obtained by spot welding flange portions of a hat member having an R of 5 mm, a base of 40 mm, a forming height of 40 mm, two flange portions of 25 mm and a length of 300 mm to a back sheet having a size of 110 mm×300 mm, and thereafter welding thereto a top sheet (250 mm square) was used to perform a crushing test. A case where a crushing strength when a compressive load was applied in the longitudinal direction was the same strength level as or exceeded the criterion is denoted by "○", and a case where the criterion was not met is denoted by "x". Further, a case where the crushing test could not be performed because cracking occurred at the time of pressing is denoted by "-".

[Test Results]

Test results for the tailored rolled blanks are shown in Table 4. Referring to Table 4, for cold rolling numbers 1-1, 2-1, 2-8, 4-1, 14-1, 18-1, 18-2, 19-1, 20-1, 21-1, 22-1 and 23-1, the hot-rolled steel sheet was suitable and the production conditions were also suitable. Consequently, the dislocation density ρ of the tailored rolled blank was $1\times10^{14}$ $m^{-2}$ or less, and the number density $n_1$ of fine Ti carbo-nitrides was more than $2\times10^{17}$ per $cm^3$. In addition, the hardness ratio HR was in a range of more than 1.0 to 1.5. Consequently, cracking did not occur in press working, and the static crushing strength was also higher than the criterion. In addition, the tensile strength TS of each tailored rolled blank was 590 MPa or more. Accordingly, tailored rolled blanks that were excellent in strength and formability were obtained.

In contrast, with regard to cold rolling number 2-2, the cold rolling rate R for the thickest wall portion was less than 5%. Consequently, an average hardness ratio HR was more than 1.5. Because there was a difference between the hardness of a thick-wall portion and the hardness of a thin-wall portion of the tailored rolled blank, cracking occurred at the time of pressing, and the formability was low.

With regard to cold rolling number 2-3, the cold rolling rate R of the thinnest wall portion was more than 50% during cold rolling. Consequently, the dislocation density ρ of the thinnest wall portion was too high and cracking occurred at the time of pressing.

With regard to cold rolling number 2-4, the highest heating temperature $T_{max}$ in the precipitation hardening heat treatment was too low. Consequently, the dislocation density ρ of the thinnest wall portion was too high. In addition, the number density $n_1$ of fine Ti carbo-nitrides was too low. As a result, cracking occurred at the time of pressing, and the formability of the tailored rolled blank was low.

With regard to cold rolling number 2-5, the highest heating temperature $T_{max}$ in the precipitation hardening heat treatment was too high. In addition, the heat treatment index IN was too high. Consequently, the number density $n_1$ of Ti carbo-nitrides was too low, and the strength after press working was too low.

With regard to cold rolling number 2-6, the holding time period $t_K$ at 600° C. or more of the precipitation hardening heat treatment was too long. Consequently, the number density $n_1$ of fine Ti carbo-nitrides was too low, and the strength after press working was too low.

With regard to cold rolling number 2-7, the heat treatment index IN was too high. Consequently, the number density $n_1$ of fine Ti carbo-nitrides was too low, and the strength after press working was too low.

With regard to cold rolling number 2-9, the highest heating temperature $T_{max}$ in the precipitation hardening heat treatment was too low, and the heat treatment index IN was also low. Consequently, the number density $n_1$ of fine Ti carbo-nitrides was too low. In addition, the average hardness ratio HR was too high. As a result, cracking occurred at the time of pressing.

With regard to cold rolling number 2-10, the highest heating temperature $T_{max}$ in the precipitation hardening heat treatment was too high. As a result, the number density $n_1$ of fine Ti carbo-nitrides was too low, and adequate strength was not obtained after press working.

With regard to cold rolling number 2-11, the holding time period $t_K$ at 600° C. or more of the precipitation hardening heat treatment was too short. As a result, the dislocation density ρ was too high, and the number density $n_1$ of fine Ti carbo-nitrides was too low. In addition, the average hardness ratio HR was too high. As a result, cracking occurred at the time of pressing.

With regard to cold rolling number 2-12, the heat treatment index IN of the precipitation hardening heat treatment was too low. As a result, the dislocation density ρ was too high, and the number density $n_1$ of fine Ti carbo-nitrides was too low. The average hardness ratio HR was also too high.

With regard to cold rolling number 3-1, the BH amount in the hot-rolled steel sheet was too low. Consequently, although the conditions for producing the tailored rolled blank were suitable, the number density $n_1$ of fine Ti carbo-nitrides was too low. As a result, the strength after press working was low.

With regard to cold rolling numbers 5-1 and 6-1, in the hot-rolled steel sheet, the BH amount was too low and the breaking elongation El was too low. Consequently, cracking occurred during cold rolling.

With regard to cold rolling numbers 7-1 and 8-1, the BH amount of the hot-rolled steel sheet that was utilized was too low. Consequently, the number density $n_1$ of fine Ti carbo-nitrides was too low. In addition, the average hardness ratio HR was too low. As a result, cracking occurred at the time of pressing.

With regard to cold rolling number 9-1, in the hot-rolled steel sheet that was utilized, the BH amount was too low and the breaking elongation El was too low. Consequently, cracking occurred during cold rolling.

With regard to cold rolling number 10-1, the pole density D1 of the utilized hot-rolled steel sheet was too high, and $|\Delta r|$ was too high. Consequently, the average hardness ratio HR was too high, and cracking occurred at the time of press working.

With regard to cold rolling number 11-1, the BH amount of the utilized hot-rolled steel sheet was too low. Further, with regard to cold rolling numbers 12-1 and 13-1, the number density $n_0$ of fine Ti carbo-nitrides in the utilized hot-rolled steel sheets was too high. Consequently, the number density $n_1$ of fine Ti carbo-nitrides was too low. In addition, the average hardness ratio HR was too low. As a result, cracking occurred at the time of pressing.

With regard to cold rolling number 15-1, a hot-rolled steel sheet in which the pole densities D1 and D2 were high and the in-plane anisotropy was large was utilized. Consequently, the hot-rolled steel sheet ruptured during cold rolling.

With regard to cold rolling numbers 16-1 and 17-1, the number density $n_0$ of fine Ti carbo-nitrides of the hot-rolled steel sheet that was utilized was too high. Consequently, the number density $n_1$ of fine Ti carbo-nitrides was too low. In addition, the average hardness ratio HR was too low. As a result, cracking occurred at the time of pressing.

With regard to cold rolling number 18-3, although a suitable hot-rolled steel sheet was used, the highest heating temperature $T_{max}$ in the precipitation hardening heat treatment was too high, and the heat treatment index IN was too high. Consequently, the number density $n_1$ of fine Ti carbo-nitrides was too low, and the average hardness ratio HR was too high. As a result, cracking occurred at the time of pressing.

With regard to cold rolling number 24-1, a hot-rolled steel sheet in which the C content was too high was used. Consequently, the hot-rolled steel sheet ruptured during cold rolling.

With regard to cold rolling number 25-1, a hot-rolled steel sheet in which the C content was too low was used. Consequently, the number density $n_1$ of fine Ti carbo-nitrides was too low, and the average hardness ratio HR was also too low. As a result, cracking occurred during press working.

With regard to cold rolling number 26-1, a hot-rolled steel sheet in which the Ti content was too high and the pole densities D1 and D2 were high was used. Consequently, the dislocation density ρ was too high, and the average hardness ratio HR was too high. As a result, cracking occurred at the time of press working.

With regard to cold rolling numbers 27-1 and 28-1, a hot-rolled steel sheet in which the Ti content was too low was used. Consequently, the number density $n_1$ of fine Ti carbo-nitrides was too low, and the hardness ratio HR was too high. As a result, cracking occurred at the time of press working.

With regard to cold rolling number 29-1, a hot-rolled steel sheet in which the N content was too high was used. As a result, the hot-rolled steel sheet ruptured during cold rolling.

With regard to cold rolling number 30-1, the pole density D3 of the hot-rolled steel sheet that was utilized was too low. Consequently, the hardness ratio HR was too high, and cracking occurred at the time of press working.

With regard to cold rolling number 31-1, in the hot-rolled steel sheet that was utilized, F1 did not satisfy Formula (1). Consequently, the number density $n_1$ of fine Ti carbo-nitrides was too low, and the hardness ratio HR was too high. As a result, cracking occurred at the time of press working.

An embodiment of the present invention has been described above. However, the above described embodiment is merely an example for implementing the present invention. Accordingly, the present invention is not limited to the above described embodiment, and the above described embodiment can be appropriately modified within a range which does not deviate from the technical scope of the present invention.

INDUSTRIAL APPLICABILITY

According to the present embodiment, a tailored rolled blank can be obtained that has a tensile strength of 590 MPa or more and also has excellent cold formability. The tailored rolled blank according to the present invention can be used for uses such as framework components of automobiles, as well as inner sheet members, structural members and underbody members with respect to which a high level of performance is demanded with regard to collision absorption energy, rigidity, fatigue strength and the like, and the industrial contribution thereof is extremely significant.

The invention claimed is:

1. A tailored rolled blank in which a sheet thickness changes in a tapered shape in a rolling direction, comprising:

a thick-wall portion, and a thin-wall portion that is thinner than the thick-wall portion;

wherein:

in the tailored rolled blank, a ratio of an average hardness $H_{t\ max}$ of a thickest wall portion at which the sheet thickness is thickest to an average hardness $H_{t\ min}$ of a thinnest wall portion at which the sheet thickness is thinnest is in a range of more than 1.0 to 1.5, an average dislocation density of the thinnest wall portion is $1\times10^{14}$ $m^{-2}$ or less, and a number density of fine Ti carbo-nitrides having a particle diameter of 10 nm or less is more than $2\times10^{17}$ per $cm^3$.

2. The tailored rolled blank according to claim 1, further comprising a galvanized layer on a surface thereof.

3. The tailored rolled blank according to claim 1, wherein the tailored rolled blank is produced using a hot-rolled steel sheet comprising:

a chemical composition consisting of, in mass %,

C: 0.03 to 0.1%,

Si: 1.5% or less,

Mn: 1.0 to 2.5%,
P: 0.1% or less,
S: 0.02% or less,
Al: 0.01 to 1.2%,
N: 0.01% or less,
Ti: 0.015 to 0.15%,
Nb: 0 to 0.1%,
Cu: 0 to 1%,
Ni: 0 to 1%,
Mo: 0 to 0.2%,
V: 0 to 0.2%,
Cr: 0 to 1%,
W: 0 to 0.5%,
Mg: 0 to 0.005%,
Ca: 0 to 0.005%,
rare earth metal: 0 to 0.1%,
B: 0 to 0.005%, and one or more types of element selected from a group consisting of Zr, Sn, Co and Zn in a total amount of 0 to 0.05%, with the balance being Fe and impurities, and satisfying Formula (1); and a microstructure containing, in terms of area ratio, 20% or more of bainite, with 50% or more in terms of area ratio of the balance being ferrite;

wherein:

at a depth position that is equivalent to one-half of a sheet thickness from a surface of the hot-rolled steel sheet, an average value of pole densities of an orientation group {100}<011> to {223}<110> comprising crystal orientations {100}<011>, {116}<110>, {114}<110>, {113}<110>, {112}<110>, {335}<110> and {223}<110> is four or less and a pole density of a {332}<113> crystal orientation is 4.8 or less;

at a depth position that is equivalent to one-eighth of the sheet thickness from the surface of the hot-rolled steel sheet, a pole density of a {110}<001> crystal orientation is 2.5 or more;

a number density of fine Ti carbo-nitrides having a particle diameter of 10 nm or less among Ti carbo-nitrides in the hot-rolled steel sheet is $1.0\times10^{17}$ per $cm^3$ or less; and a bake hardening amount is 15 MPa or more;

$$[Ti]-48/14\times[N]-48/32\times[S]\geq0 \quad (1),$$

where a content (mass %) of a corresponding element is substituted for each symbol of an element in Formula (1).

4. The tailored rolled blank according to claim 3, further comprising a galvanized layer on a surface thereof.

* * * * *